US008339432B2

(12) United States Patent
Kawashima

(10) Patent No.: US 8,339,432 B2
(45) Date of Patent: Dec. 25, 2012

(54) CONVEYANCE MECHANISM, RECORDING APPARATUS INCLUDING THE CONVEYANCE MECHANISM, AND ROLL PAPER CONVEYANCE METHOD USING THE CONVEYANCE MECHANISM

(75) Inventor: Hideki Kawashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 347 days.

(21) Appl. No.: 12/834,769

(22) Filed: Jul. 12, 2010

(65) Prior Publication Data

US 2011/0012978 A1 Jan. 20, 2011

(30) Foreign Application Priority Data

Jul. 14, 2009 (JP) ..... 2009-165680

(51) Int. Cl.
*B41J 15/04* (2006.01)

(52) U.S. Cl. ..... 347/218

(58) Field of Classification Search ..... 347/218; 400/611; 242/563.1, 566
See application file for complete search history.

(56) References Cited

U.S. PATENT DOCUMENTS 8,243,291 B2 * 8/2012 Kojima ..... 358/1.1
2009/0324314 A1 12/2009 Tanabe

FOREIGN PATENT DOCUMENTS

JP 5-16476 1/1993
JP 2008-229896 10/2008

* cited by examiner

*Primary Examiner* — Huan Tran
(74) *Attorney, Agent, or Firm* — Canon USA Inc. IP Division

(57) ABSTRACT

A conveyance mechanism is configured to convey a leading part of a roll paper pulled out of a wound part of the roll paper via a conveyance path including a curved portion bent toward an opposite direction to a winding direction of the roll paper wound in a roll shape. The conveyance mechanism includes a control unit configured to control conveyance of the roll paper in such a manner that a front end portion of the roll paper becomes greater with respect to number of times or total time in passing through the curved portion compared to a central portion of the leading part of the roll paper pulled out of the roll paper wound in the roll shape in a longitudinal direction.

18 Claims, 23 Drawing Sheets

FIG.14

| NUMBER OF REMAINING PRINTABLE SHEETS | NUMBER OF TIMES OF RECIPROCATING CONVEYANCE OPERATION |
|---|---|
| EQUAL TO OR GREATER THAN 60 SHEETS | 1 TIME |
| EQUAL TO OR GREATER THAN 40 AND LESS THAN 60 SHEETS | 2 TIMES |
| EQUAL TO OR GREATER THAN 20 AND LESS THAN 40 SHEETS | 3 TIMES |
| LESS THAN 20 SHEETS | 5 TIMES |

FIG.23A

| NUMBER OF REMAINING PRINTABLE SHEETS | STOP DURATION | NUMBER OF TIMES OF STOP |
|---|---|---|
| EQUAL TO OR GREATER THAN 60 SHEETS | 0.5 SEC | 3 TIMES |
| EQUAL TO OR GREATER THAN 40 AND LESS THAN 60 SHEETS | 0.5 SEC | 4 TIMES |
| EQUAL TO OR GREATER THAN 20 AND LESS THAN 40 SHEETS | 0.5 SEC | 5 TIMES |
| LESS THAN 20 SHEETS | 0.5 SEC | 6 TIMES |

FIG.23B

| NUMBER OF REMAINING PRINTABLE SHEETS | STOP DURATION | NUMBER OF TIMES OF STOP |
|---|---|---|
| EQUAL TO OR GREATER THAN 60 SHEETS | 0.5 SEC | 3 TIMES |
| EQUAL TO OR GREATER THAN 40 AND LESS THAN 60 SHEETS | 1 SEC | 3 TIMES |
| EQUAL TO OR GREATER THAN 20 AND LESS THAN 40 SHEETS | 1.2 SEC | 3 TIMES |
| LESS THAN 20 SHEETS | 1.8 SEC | 3 TIMES |

CONVEYANCE MECHANISM, RECORDING APPARATUS INCLUDING THE CONVEYANCE MECHANISM, AND ROLL PAPER CONVEYANCE METHOD USING THE CONVEYANCE MECHANISM

BACKGROUND OF THE INVENTION

1. Field of the Invention

The present invention relates to a roll paper conveyance mechanism, a recording apparatus including the conveyance mechanism, and a roll paper conveyance method.

2. Description of the Related Art

The recent progress in recording technology enables numerous recording apparatuses, which are widely used in various fields, to input image data of a subject captured by an imaging apparatus (e.g., a digital camera) and record a captured image on a recording medium (e.g., a photographic printing paper). For example, if an ink ribbon and a photographic printing paper are set in advance, this kind of recording apparatus can easily perform recording processing based on acquired image data in response to a recording instruction. As an example of this kind of recording apparatus, a printer discussed in Japanese Patent Application Laid-Open No. 2008-229896 includes a cartridge capable of accommodating both an ink ribbon and a photographic printing paper.

A roll paper (i.e., a belt-like photographic printing paper wound around a roller) can be used as a photographic printing paper to be accommodated in the cartridge. The roll paper usable as a photographic printing paper is advantageous in that a great amount of photographic printing medium can be stored in a limited space of a compact cartridge. Further, a conveyance mechanism can be commonly used for various cartridges that are different in print size.

As the roll paper is constantly held in a curled state, a recording apparatus is required to include a mechanism for correcting winding curl of the roll paper. As an example, the winding curl correction mechanism discussed in Japanese Patent Application Laid-Open No. 2008-229896 includes a decurling roller. The decurling roller is made of a soft rubber and is pressed against a hard decurling driven roller, which is disposed in a confronting relationship with the decurling roller. When a roll paper moves beyond a clearance between the decurling roller and the driven roller, the roll paper travels along a curved path that is bent approximately 90 degrees. According to the above-described configuration of the winding curl correction mechanism discussed in Japanese Patent Application Laid-Open No. 2008-229896, the roll paper can be forcibly rubbed in a direction opposed to the winding direction of the roll paper in such a manner that the winding curl of the roll paper can be reduced or eliminated.

Further, a winding curl correction mechanism discussed in Japanese Patent Application Laid-Open No. 5-16476 includes a conveyance path to be pressed against an outer circumferential surface of a recording paper wound in a roll shape and having a curvature opposed to the cylindrical surface of the recording paper. According to the winding curl correction mechanism discussed in Japanese Patent Application Laid-Open No. 5-16476, the recording paper is rubbed in a direction opposed to the winding direction when the recording paper passes through the conveyance path.

The winding curl correction mechanism discussed in Japanese Patent Application Laid-Open No. 2008-229896 requires two rollers that are disposed in the conveyance path to reduce or eliminate the winding curl of a roll paper. Therefore, a roll paper conveyance mechanism for the above-described winding curl correction mechanism becomes larger in size.

In a case where a conveyance path having a curvature is provided as a winding curl correction mechanism as discussed in Japanese Patent Application Laid-Open No. 5-16476, the effect of correcting the winding curl of a roll paper is variable depending on a portion of the roll paper.

For example, when a central portion of a stretched part of the roll paper having been pulled out of a wound part of the roll paper in the longitudinal direction reaches the curved portion of the conveyance path, an upstream part of the roll paper positioned on the upstream side of the curved portion in a conveyance direction is held by a constituent member of the apparatus. In this state, if the roll paper is pulled from a downstream side in the conveyance direction, a tensile force acts on the stretched part of the roll paper having been pulled out of the wound part of the roll paper in the longitudinal direction. Therefore, the central portion of the stretched part of the roll paper tightly contacts an inner wall of the conveyance path. As a result, the central portion of the stretched part of the roll paper is rubbed by the inner wall of the conveyance path. Rubbing the roll paper in the above-described manner is useful to enhance the winding curl correction effect.

However, when a front end portion of the roll paper passes through the conveyance path, no tensile force acts on the front end portion of the roll paper. More specifically, the roll paper cannot be pulled from the downstream side when the roll paper is delivered forward. Further, when the roll paper is taken up backward, a downstream part of the roll paper cannot be firmly held. Accordingly, in both cases, the front end portion of the roll paper does not tightly contact the inner wall of the conveyance path.

As described above, if a significant amount of tensile force acts on a roll paper while the roll paper is conveyed in the conveyance path, the roll paper can be sufficiently rubbed by the inner wall of the conveyance path. In this case, the winding curl correction effect can be obtained sufficiently. On the other hand, if no tensile force acts on the roll paper while the roll paper is conveyed in the conveyance path, the roll paper does not tightly contact the inner wall of the conveyance path. The winding curl correction effect obtained in the latter case is insufficient. In particular, the winding curl correction effect at the front end portion of the roll paper is not satisfactory, as described above.

Accordingly, uniform correction effect cannot be obtained for the entire roll paper. The quality of a print product obtained by the above-described conventional apparatus may be unacceptable. The above-described problem is not limited to a case where the stretched part of the roll paper is pulled when it is conveyed. Similar problem may arise when a wound part (i.e., a rolled part) of the roll paper is pulled when it is conveyed.

SUMMARY OF THE INVENTION

The present invention is directed to a conveyance mechanism, a recording apparatus including the conveyance mechanism, and a conveyance method, which are capable of obtaining uniform winding curl correction effect at every portion of a roll paper wound in a roll shape.

According to an aspect of the present invention, a conveyance mechanism is configured to convey a leading part of a roll paper pulled out of a wound part of the roll paper via a conveyance path including a curved portion bent toward a direction opposed to a winding direction of the roll paper wound in a roll shape. The conveyance mechanism includes a control unit configured to control conveyance of the roll paper in such a manner that a front end portion of the roll paper becomes greater with respect to number of times or total time in passing through the curved portion compared to a central portion of the leading part of the roll paper pulled out of the roll paper wound in the roll shape in a longitudinal direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 14 is a table illustrating an example relationship between the number of remaining printable sheets and the number of times of roll paper reciprocating conveyance operation.

FIGS. 23A and 23B are tables illustrating an example relationship between stop time in roll paper conveyance processing and the number of times of the stoppage.

DESCRIPTION OF THE EMBODIMENTS

Various exemplary embodiments, features, and aspects of the invention will be described in detail below with reference to the drawings.

A printing apparatus according to an exemplary embodiment of the present invention includes a detachable cartridge that can accommodate a roll paper wound in a roll shape and an ink ribbon, although the present invention is not limited to the illustrated example. The present invention relates to a conveyance mechanism capable of conveying a roll paper wound in a roll shape and also relates to a relevant conveyance method. Further, the conveyance mechanism according to the exemplary embodiment is generally applicable to a recording apparatus that performs recording on a roll paper.

Figure 1:
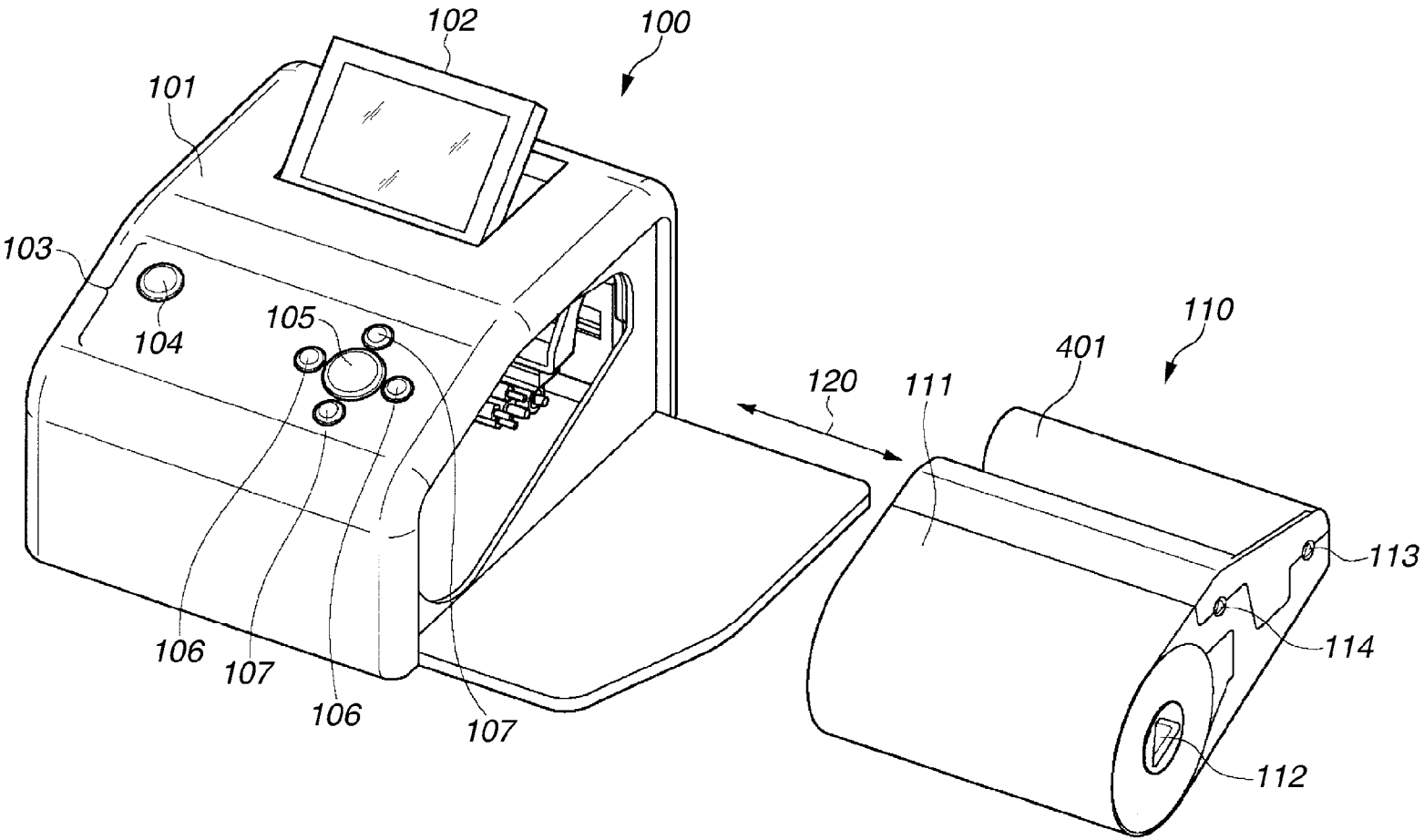
FIG. 1 is a perspective view illustrating a printing apparatus and a cartridge according to an exemplary embodiment of the present invention.

FIG. 1 illustrates an external appearance of a printing apparatus 100 and a cartridge 110 usable for the printing apparatus 100 according to the present exemplary embodiment. As illustrated in FIG. 1, the printing apparatus 100 includes a casing 101 having a side surface portion that can be opened to enable users to attach and detach the cartridge 110 in a direction indicated by an arrow 120. The printing apparatus 100 further includes a display unit 102 and an operation unit 103 provided at an upper part of the casing 101.

The display unit 102 includes a display screen that can be constituted, for example, by a liquid crystal display (LCD). The display unit 102 can display image data to be printed, and can display a menu that enables users to select setting data to be referred to when the printing apparatus 100 performs printing. The operation unit 103 includes a power switch 104 that is operable to instruct power ON/OFF of the printing apparatus 100 and a selection switch 105 that is operable to select various menus to be displayed on the display unit 102. The operation unit 103 further includes a right-and-left key 106 and an up-and-down key 107 that are located around the selection switch 105 and operable to move a cursor on the display unit 102 to a desired position of the displayed screen.

The cartridge 110 can store an ink ribbon on which ink layers are coated and a roll paper serving as a medium on which an image can be formed. The roll paper is wound into a roll shape. The roll paper is covered with a housing 111 in a state where the cartridge 110 is not yet attached to the printing apparatus 100. Therefore, users cannot directly touch the roll paper. In this manner, the cartridge 110 can prevent foreign particles or contaminants from entering inside thereof. When the printing apparatus 100 performs printing, the roll paper is pulled out of the cartridge 110 and a thermal head provided in the printing apparatus 100 transfers a part of the ink coated on the ink ribbon to the roll paper.

Figure 2:
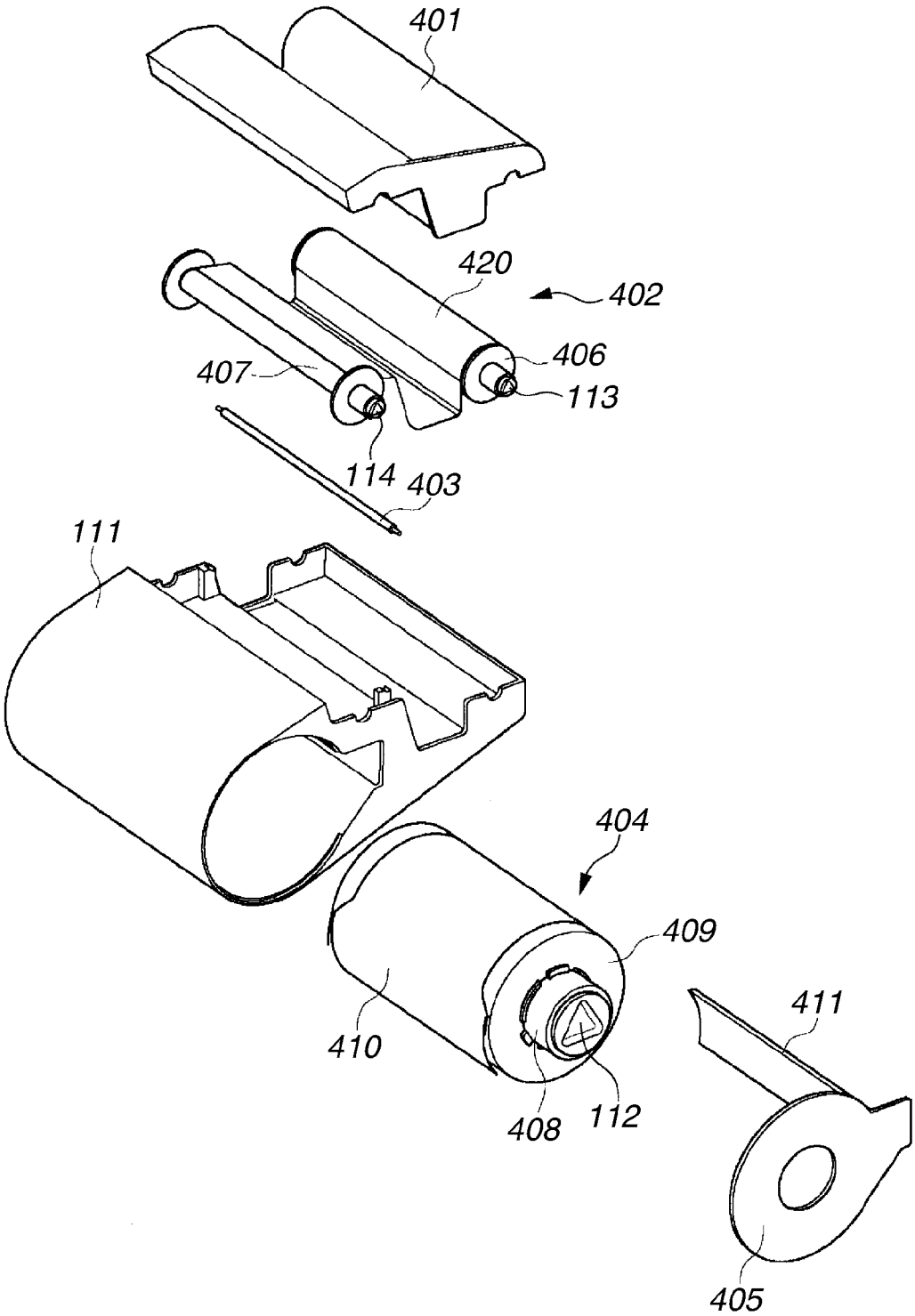
FIG. 2 is an exploded perspective view of the cartridge illustrated in FIG. 1.

Next, an example configuration of the cartridge 110 is described below in more detail. FIG. 2 is an exploded perspective view illustrating the cartridge 110. The cartridge 110 includes the housing 111, an upper housing 401, an ink ribbon unit 402, and a roll paper unit 404.

The upper housing 401 covers an upper portion of the ink ribbon unit 402 placed in the housing 111. The ink ribbon unit 402 includes a supply roller 406 and a take-up roller 407. The supply roller 406 holds an ink ribbon 420 to be used, which is wound in a roll shape. A used part of the ink ribbon 420 is wound around the take-up roller 407. The supply roller 406 is supported by the housing 111 so as to be freely rotatable around its rotational shaft 113. The take-up roller 407 is supported by the housing 111 so as to be freely rotatable around its rotational shaft 114.

In a state where the cartridge 110 is attached to the printing apparatus 100, the rotational shaft 114 of the take-up roller 407 can be driven and rotated by an ink ribbon winding motor 217 included in the printing apparatus 100. A guide roller 403 regulates a conveyance path of the ink ribbon 420 when the take-up roller 407 takes up a used part of the ink ribbon 420. The guide roller 403 is supported by the housing 111 so as to be freely rotatable around its rotatable shaft.

The roll paper unit 404 includes a roller 408 and a flange 409. A roll paper 410 is wound around the roller 408. The roll paper 410 has a roll shape. The roller 408 is supported between a side housing 405 positioned at one side of the housing 111 and the housing 111 so as to be freely rotatable around its rotatable shaft 112. In the state where the cartridge 110 is attached to the printing apparatus 100, the rotational shaft 112 of the roller 408 around which the roll paper 410 is wound can be driven and rotated by a feeding motor provided in the printing apparatus 100.

The side housing 405 covers a side surface of the roll paper unit 404 stored in the housing 111 and supports the roller 408 in a rotatable state. Further, the side housing 405 includes a separation member 411 that can pick up a front end portion of the roll paper 410 wound around the roller 408.

Figure 3:
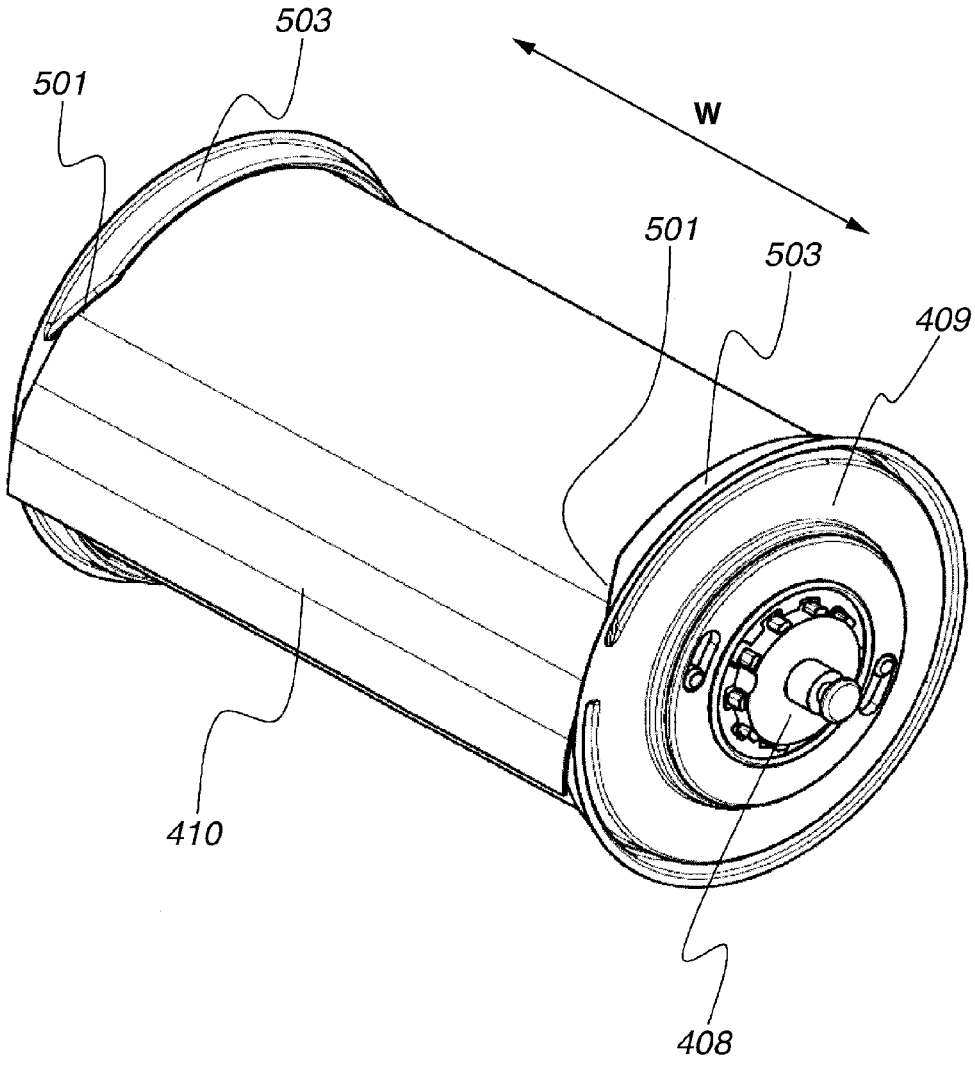
FIG. 3 is a perspective view illustrating a roll paper unit included in the cartridge illustrated in FIG. 2.

Next, the roll paper unit 404 is described in more detail with reference to FIG. 3. The flange 409, which is made of an elastic member, is provided at both ends of the roller 408. The flange 409 can prevent the roll paper 410 from moving in a width direction W. Further, the flange 409 has a stopper flange portion 503. The stopper flange portion 503 prevents the roll paper 410 from expanding in radial directions due to the rigidity of the roll paper 410. A cutout portion 501 is formed on the stopper flange portion 503. The cutout portion 501 serves as a member capable of gripping both ends of the front end portion of the roll paper 410.

Figure 4A:
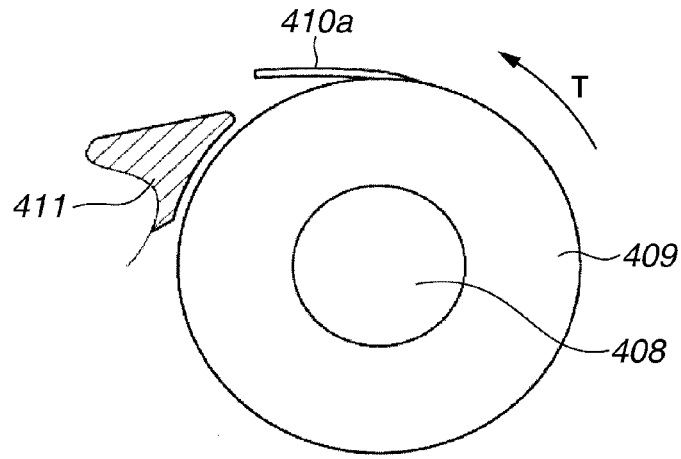
FIGS. 4A to 4C illustrate a function of a separation member.
Figure 4B:
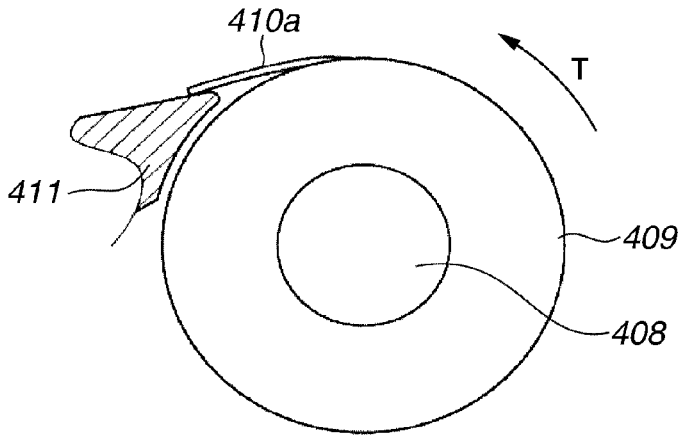
Figure 4C:
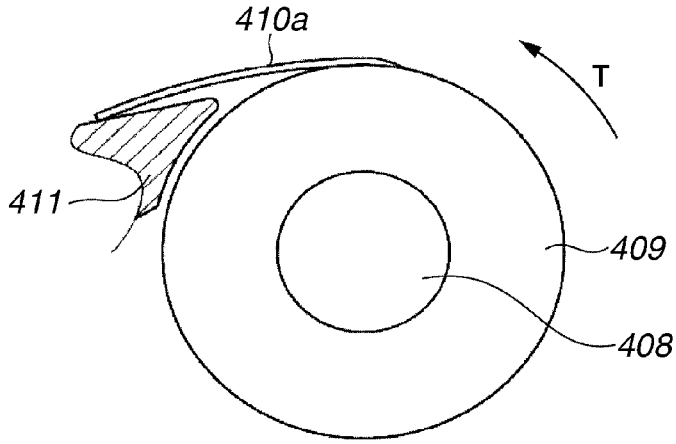

Next, the separation member 411 provided on the side housing 405 of the cartridge 110 is described below in detail with reference to FIGS. 4A to 4C. FIGS. 4A to 4C illustrate an example relationship between the separation member 411 and the roll paper unit 404.

When the roller 408 of the roll paper unit 404 rotates, the roll paper unit 404 rotates in a direction identical to the rotational direction of the roller 408. When the roll paper unit 404 rotates in a roll paper feeding direction T, a front end portion 410*a* of the roll paper 410 held by the flange 409 is guided by the separation member 411 toward a roll paper exit of the cartridge 110.

As illustrated in FIG. 4A, the front end portion 410*a* of the roll paper 410 is held by the flange 409. As illustrated in FIG. 4B, the separation member 411 can guide the front end portion 410*a* of the roll paper 410 while the roll paper unit 404 rotates. When the roll paper unit 404 further rotates, the roll paper 410 accommodated in the roll paper unit 404 can be delivered outward while the flanges 409 provided at both ends of the roll paper 410 deform elastically. Then, as illustrated in FIG. 4C, the front end portion 410*a* of the roll paper 410 moves forward along an upper surface of the separation member 411.

Figure 5:
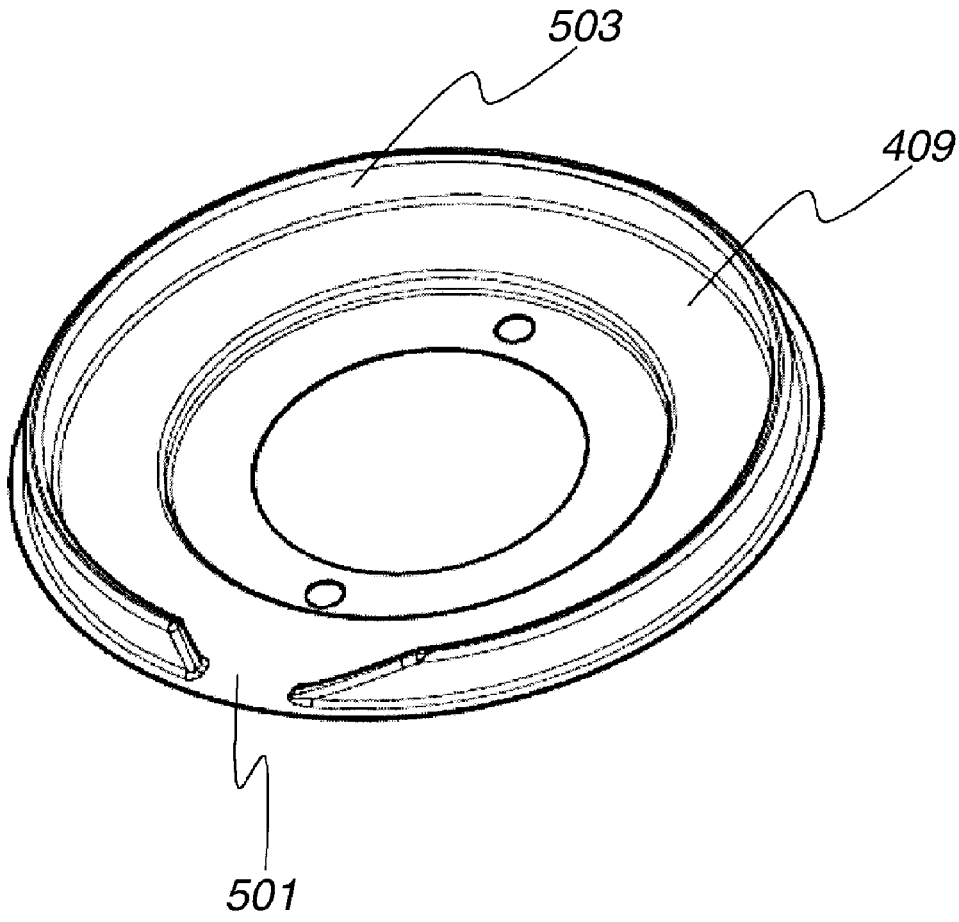
FIG. 5 is a perspective view illustrating a flange included in the roll paper unit illustrated in FIG. 3.
Figure 6A:
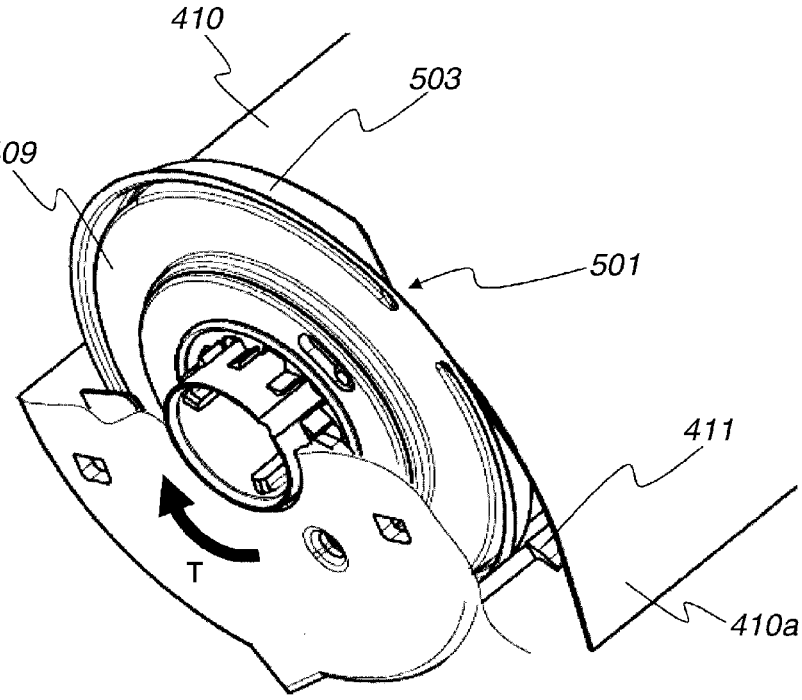
FIGS. 6A and 6B illustrate an operation of the roll paper unit.
Figure 6B:
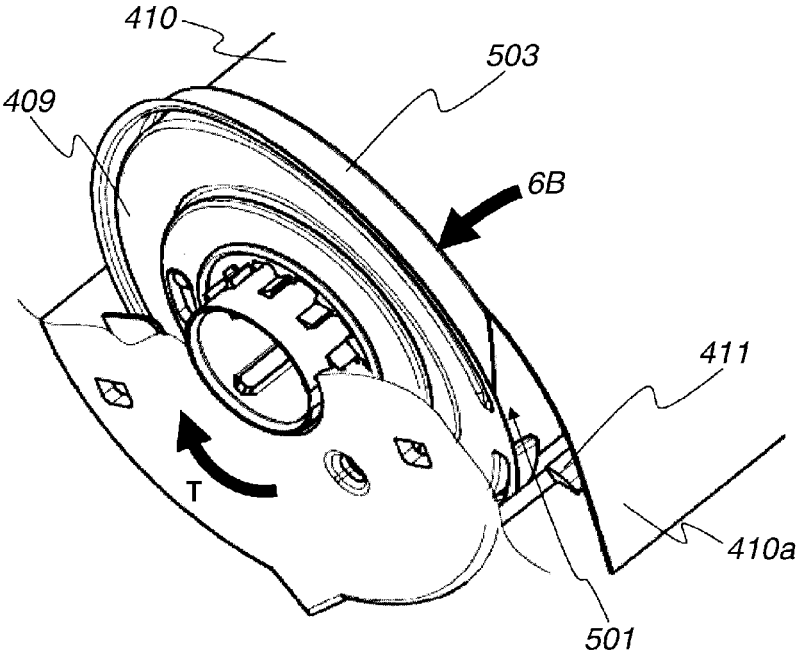

FIG. 5 illustrates a perspective view illustrating the flange 409. In a state where the roll paper 410 protrudes beyond the cutout portion 501 formed on the stopper flange portion 503 of the flange 409, the flange 409 is not elastically deformed. FIGS. 6A and 6B illustrate an example condition where the roll paper 410 causes the flange 409 to elastically deform, and the roll paper 410 is positioned outside the flange 409.

When the roll paper 410 is delivered, the roll paper 410 can move forward while the roll paper 410 elastically deforms the flanges 409. FIG. 6A illustrates a state where the front end portion 410*a* of the roll paper 410 protrudes beyond the cutout portion 501 of the flange 409 in a state where the roll paper 410 is held between two flanges 409 at both sides thereof.

In this state, each flange 409 is not deformed. The front end portion 410*a* of the roll paper 410 is positioned outside the stopper flange portion 503 of the flange 409. From this condition, if the roll paper unit 404 rotates in the roll paper feeding direction T, the front end portion 410*a* of the roll paper 410 is raised upward by the separation member 411 as described above (see FIG. 6B).

FIG. 6B illustrates the flange 409 having elastically deformed in a direction indicated by an arrow 6B, in a state where both ends of the roll paper 410 are sandwiched by the stopper flange portions 503 of the opposed flanges 409 in the width direction. When the clearance between the outwardly deformed flanges 409 provided at both ends of the roll paper 410 becomes substantially equal to the width of the roll paper 410, the roll paper 410 can protrude over the stopper flange portions 503 toward the outside of the flanges 409.

As described above, the supporting portions of both ends of the roll paper 410 are elastically deformable, so that the roll paper 410 can be delivered outward when the roll paper unit 404 rotates. Further, if the roll paper unit 404 stops rotating, the roll paper unit 404 maintains a standby state while holding the roll paper 410.

Figure 7:
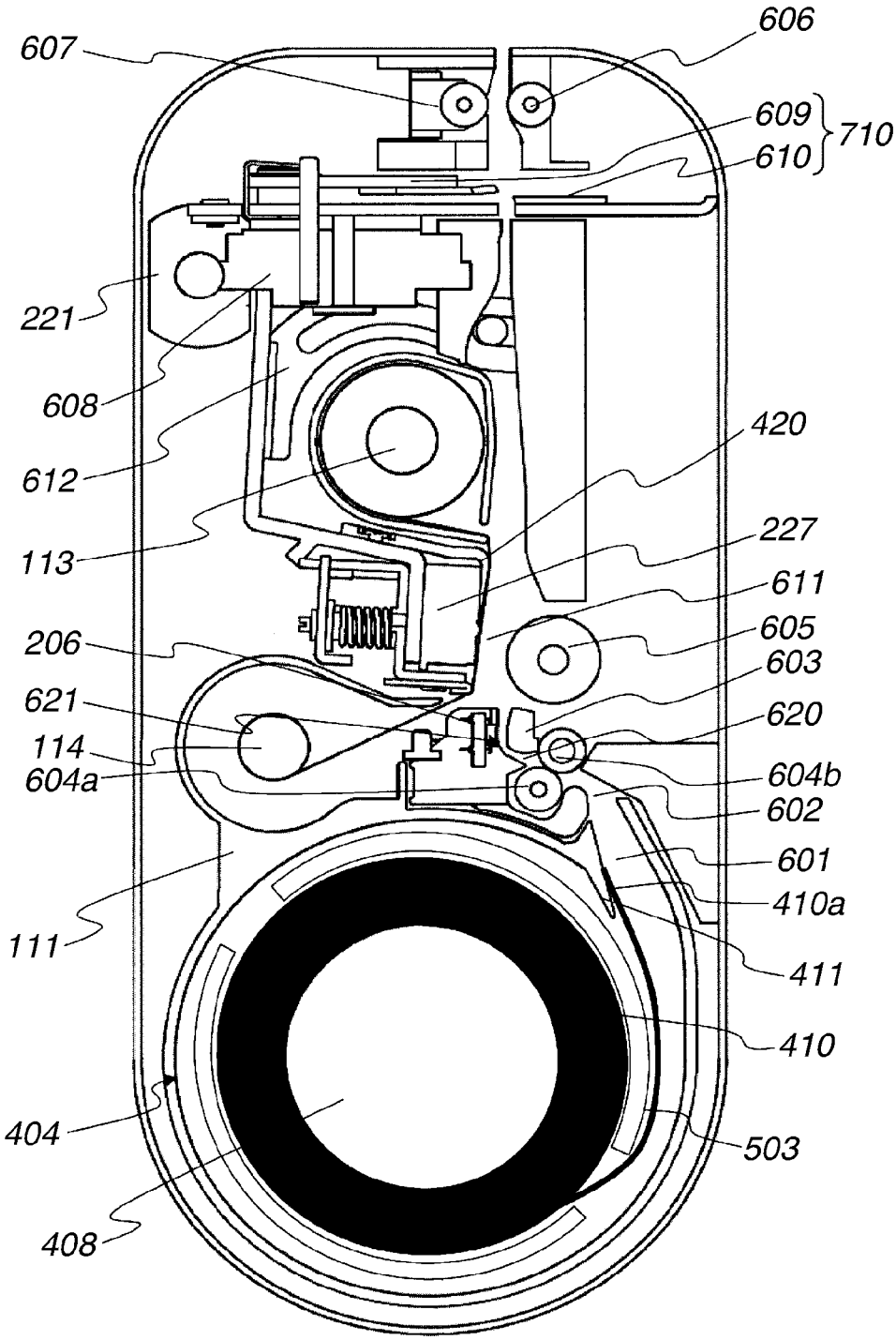
FIG. 7 is a schematic cross-sectional view illustrating the printing apparatus assembled with the cartridge.

FIG. 7 is a schematic cross-sectional view illustrating the printing apparatus 100 assembled with the attached cartridge 110. The cartridge 110 includes a feeding path 601 along which the roll paper 410 can be delivered from the cartridge 110. A roll paper exit 602 of the cartridge 110 is provided on the downstream side of the feeding path 601.

The front end portion 410*a* of the roll paper 410 wound around the roller 408 of the roll paper unit 404 is separated by the separation member 411 and guided toward the roll paper exit 602 via the feeding path 601.

The printing apparatus 100 includes a conveyance mechanism capable of conveying the roll paper 410. The conveyance mechanism includes a pinch roller 604*a*, a grip roller 604*b*, and a conveyance path 620. When the grip roller 604*b* rotates with the roll paper 410 held around it, the roll paper 410 can be accurately conveyed by the paired rollers 604*a* and 604*b*. When the grip roller 604*b* rotates in the clockwise direction in FIG. 7, a leading part of the roll paper 410 fed from the cartridge 110 can be conveyed toward a printing position 611 of the printing apparatus 100.

The roll paper exit 602 of the cartridge 110 is connected to the printing position 611 of the printing apparatus 100 via the conveyance path 620 that conveys the roll paper 410. The conveyance path 620 includes a curved portion 621. The curved portion 621 is regulated by a guide member 603 that can serve as a decurling member. The curved portion 621 has a curvature that is substantially opposite to a wounding direction of the roll paper 410. The curved portion 621 serves as part of a mechanism for correcting (decurling) winding curl of the roll paper 410 when the roll paper 410 passes through the curved portion 621.

The printing apparatus 100 includes a thermal head 227 and a platen roller 605. The platen roller 605 holds the roll paper 410 at the printing position 611. The ink ribbon 420 and the roll paper 410 are maintained in a mutually overlapped state between the thermal head 227 and the platen roller 605.

A discharge roller 606 is provided on the downstream side of the platen roller 605 in the conveyance direction of the roll paper 410. The discharge roller 606 can discharge the roll paper 410 to the outside of the printing apparatus 100. Further, a driven roller 607 is provided in a confronting relationship with the discharge roller 606. The discharge roller 606 and the driven roller 607 are driven by a common driving mechanism (not illustrated) so that they are brought into a pressed state and into a separated state. The roll paper 410 can be discharged to the outside of the printing apparatus 100 when the discharge roller 606 and the driven roller 607 rotate together while holding the roll paper 410 between them.

It is desired that the printing apparatus 100 includes a cutter unit 710 configured to cut the roll paper 410. The cutter unit 710 includes a cutter blade 609 and a cutter receiving blade 610. In this case, the printing apparatus 100 further includes a cutter motor 221 and a gear train 608. The gear train 608 can transmit an operational motion of the cutter motor 221 to the cutter unit 710.

The cutter blade 609 and the cutter receiving blade 610 are disposed on opposite sides of the conveyance path of the roll paper 410 in a mutually spaced confronting relationship. Both of the cutter blade 609 and the cutter receiving blade 610 can be driven by the gear train 608. When the cutter blade 609 and the cutter receiving blade 610 perform relative slide motions in the up-and-down direction, the roll paper 410 can be cut by two blades 609 and 610.

Figure 8:
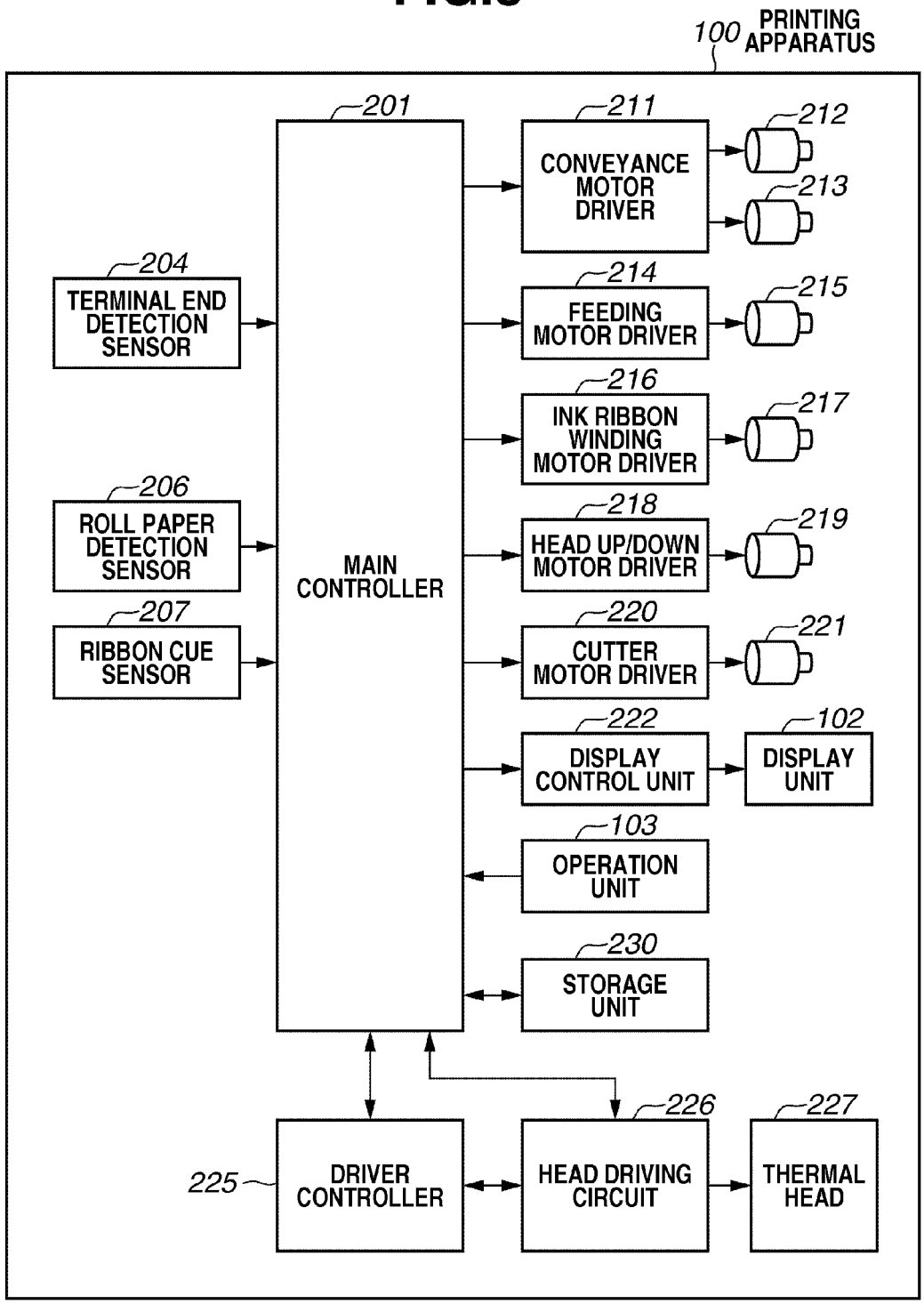
FIG. 8 is a block diagram illustrating a functional configuration of the printing apparatus illustrated in FIG. 1.

FIG. 8 is a block diagram illustrating a configuration of the printing apparatus 100. The printing apparatus 100 includes a main controller 201 that can control various operations to be performed by the printing apparatus 100. The main controller 201 can function as a control unit configured to control the conveyance of the roll paper 410. The control unit is included in the conveyance mechanism according to the present exemplary embodiment.

Further, the printing apparatus 100 according to the present exemplary embodiment includes two conveyance motors 212 and 213, a feeding motor 215, an ink ribbon winding motor 217, a head up/down motor 219, and the cutter motor 221.

The printing apparatus 100 includes a conveyance motor driver 211, a feeding motor driver 214, an ink ribbon winding motor driver 216, a head up/down motor driver 218, and a cutter motor driver 220, which can serve as drivers capable of controlling driving operations of the above-described motors.

The conveyance motor driver 211 can drive the conveyance motors 212 and 213. The conveyance motor 212 generates a driving force to be transmitted via a rotation mechanism to the grip roller 604*b*. Similarly, the conveyance motor 213 generates a driving force to be transmitted via a rotation mechanism to the discharge roller 606. Therefore, these rollers are rotated and the roll paper 410 is conveyed.

The feeding motor driver 214 can control a rotational operation of the feeding motor 215. In a state where the cartridge 110 is attached to the printing apparatus 100, the feeding motor 215 winds the roll paper 410 in the cartridge 110. The roller 408 of the roll paper unit 404, around which the roll paper 410 is wound, is connected to the feeding motor 215 via the rotation mechanism. The feeding motor driver 214 can control a rotational operation of the roller 408.

The ink ribbon winding motor driver 216 can control a rotational operation of the ink ribbon winding motor 217. In the state where the cartridge 110 is attached to the printing apparatus 100, the take-up roller 407 of the ink ribbon is connected to the ink ribbon winding motor 217 via the rotation mechanism. Accordingly, the ink ribbon winding motor driver 216 can control an ink ribbon take-up operation and an ink ribbon winding operation.

The head up/down motor driver 218 can control a rotational operation of the head up/down motor 219 that moves the thermal head 227 in the vertical direction. Therefore, the thermal head 227 can move between the printing position 611 and a retracted position (i.e., a position retracted from the printing position). The cutter motor driver 220 can control the cutter motor 221.

It is desired that the cartridge 110 includes a terminal end detection sensor 204. The terminal end detection sensor 204 is disposed on the roller 408 of the cartridge 110. When a remaining amount of the roll paper 410 wound around the roller 408 becomes less than a predetermined amount corresponding to a final rotation of the roller 408, the terminal end detection sensor 204 generates a detection signal. When the terminal end detection sensor 204 detects the terminal end of the roll paper 410, a message informing that the remaining amount of the roll paper 410 is insufficient is displayed on the display unit 102 of the printing apparatus 100.

Further, it is desired that the printing apparatus 100 includes a roll paper detection sensor 206. The roll paper detection sensor 206 is disposed at the curved portion 621 (or in the vicinity of the curved portion 621) in the conveyance path 620 between the platen roller 605 and the grip roller 604*b*. The roll paper detection sensor 206 detects a moment when the front end portion 410*a* of the roll paper 410 pulled out of the cartridge 110 has passed through the downstream side of the grip roller 604*b* in the conveyance direction.

Further, the printing apparatus 100 includes a ribbon cue sensor 207 that can detect an identification band of each color ink ribbon coated at the front end portion thereof. The ink ribbon winding operation to be performed by the ink ribbon winding motor 217 is controlled based on a detection result of the ribbon cue sensor 207.

Further, it is desired that the printing apparatus 100 includes a storage unit 230 that stores information required to control the conveyance of the roll paper 410. The storage unit 230 is, for example, constituted by a memory. Further, a display control unit 222 can control the information displayed on the display unit 102.

Figure 9:
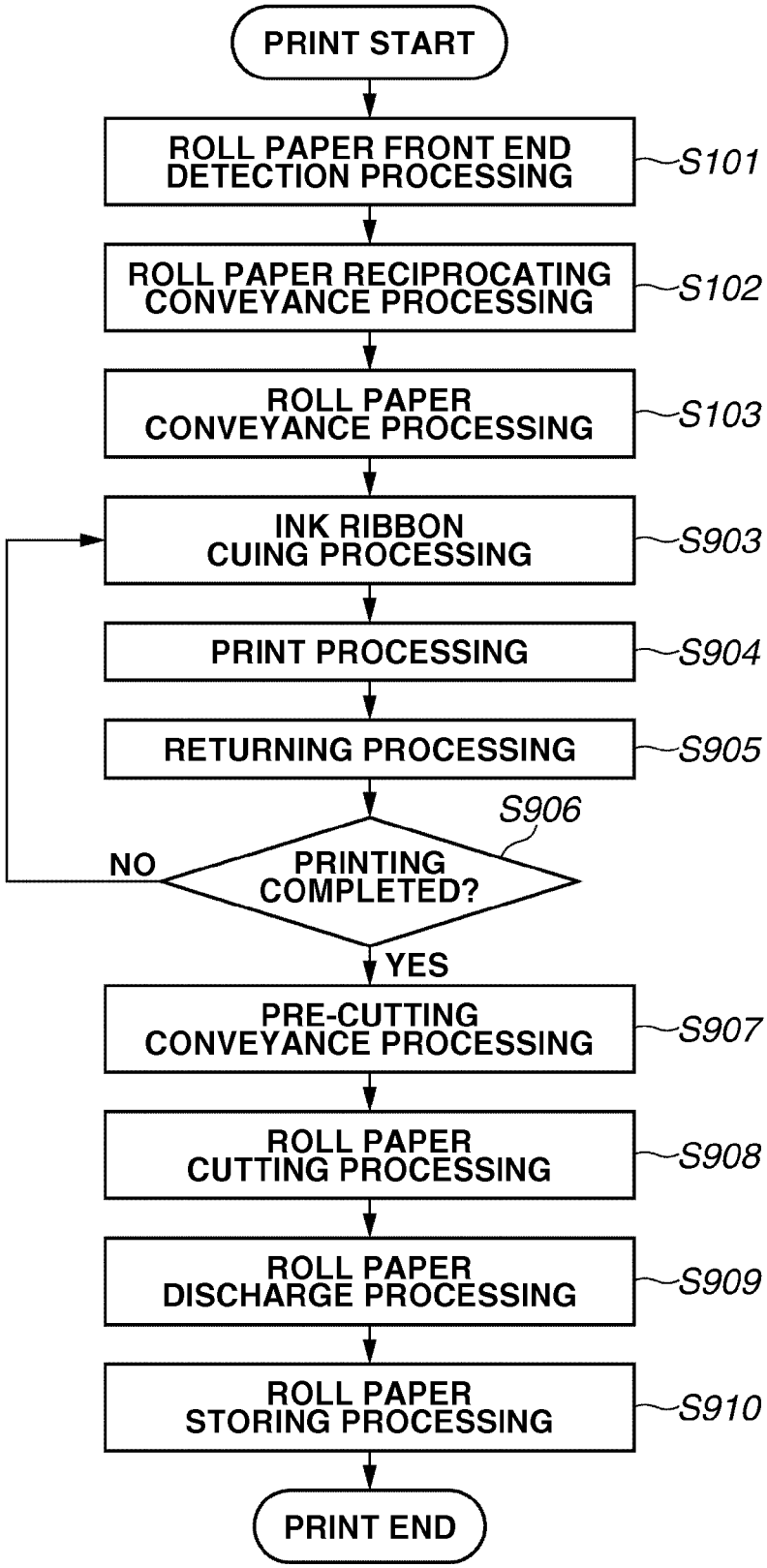
FIG. 9 is a flowchart illustrating an example procedure of print processing that can be performed by the printing apparatus according to a first exemplary embodiment of the present invention.
Figure 10:
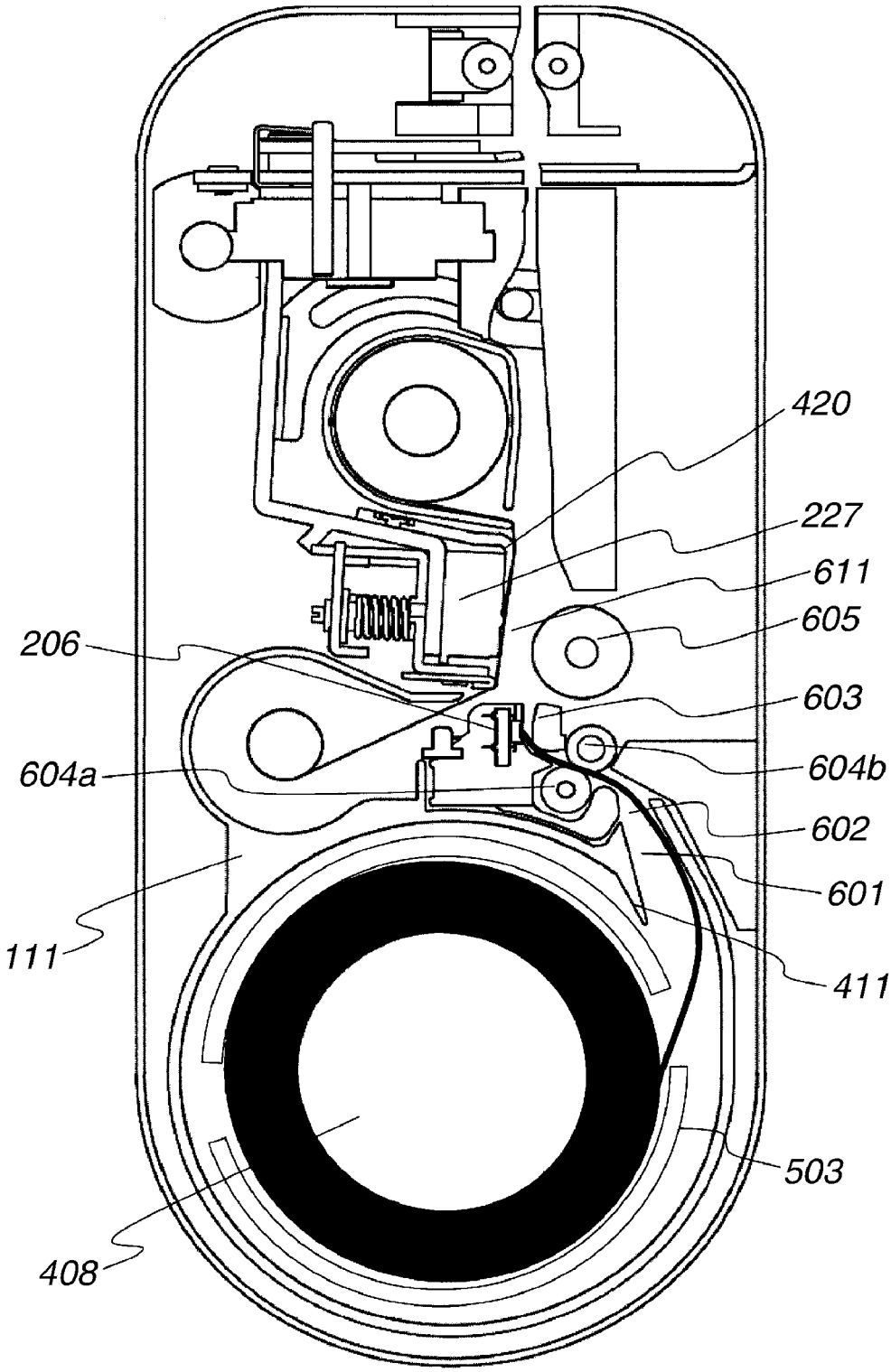
FIG. 10 illustrates a momentary position of a front end portion of a roll paper that is conveyed in the printing apparatus.

Next, print processing to be performed by the printing apparatus according to the present exemplary embodiment is described below. FIG. 9 is a flowchart illustrating an example procedure of the print processing that can be performed by the printing apparatus 100. The flowchart illustrated in FIG. 9 includes sequential operations (from print start to print end) to be performed in the print processing, contents of which are described below in more detail with reference to FIGS. 10 to 14.

First, an operation for pulling the roll paper 410, which is wound in a roll shape, out of the cartridge 110 and conveying a leading part of the roll paper 410 toward the printing position 611 is described. At the print start timing, the front end portion 410*a* of the roll paper 410 is positioned in the cartridge 110.

In step S101, the main controller 201 performs roll paper front end detection processing. In this step, the main controller 201 causes the feeding motor driver 214 to control the feeding motor 215 to rotate the roller 408 of the roll paper unit 404 in a predetermined direction to deliver the roll paper 410. Therefore, the leading part of the roll paper 410 moves toward the roll paper exit 602. Then, the front end portion 410*a* of the roll paper 410 passes through a clearance between the grip roller 604*b* and the pinch roller 604*a*. Thus, the roll paper 410 is held between the grip roller 604*b* and the pinch roller 604*a* (see FIG. 10).

In this state, the roll paper 410 can be accurately conveyed because the reverse surface of the roll paper 410 is firmly held by projections provided on the grip roller 604*b*. When the front end portion 410*a* of the roll paper 410 reaches a position illustrated in FIG. 10, the roll paper detection sensor 206 provided at a position opposed to the guide member 603 detects the front end portion 410*a* of the roll paper 410.

If the roll paper front end detection processing (step S101) is completed, then in step S102, the main controller 201 performs roll paper reciprocating conveyance processing. First, in the roll paper reciprocating conveyance processing to be performed in step S102, the main controller 201 controls the conveyance motor 212 via the conveyance motor driver 211 to convey the roll paper 410 forward until the front end portion 410*a* of the roll paper 410 passes through the curved portion 621 of the conveyance path 620 as illustrated in FIG. 11.

Figure 11:
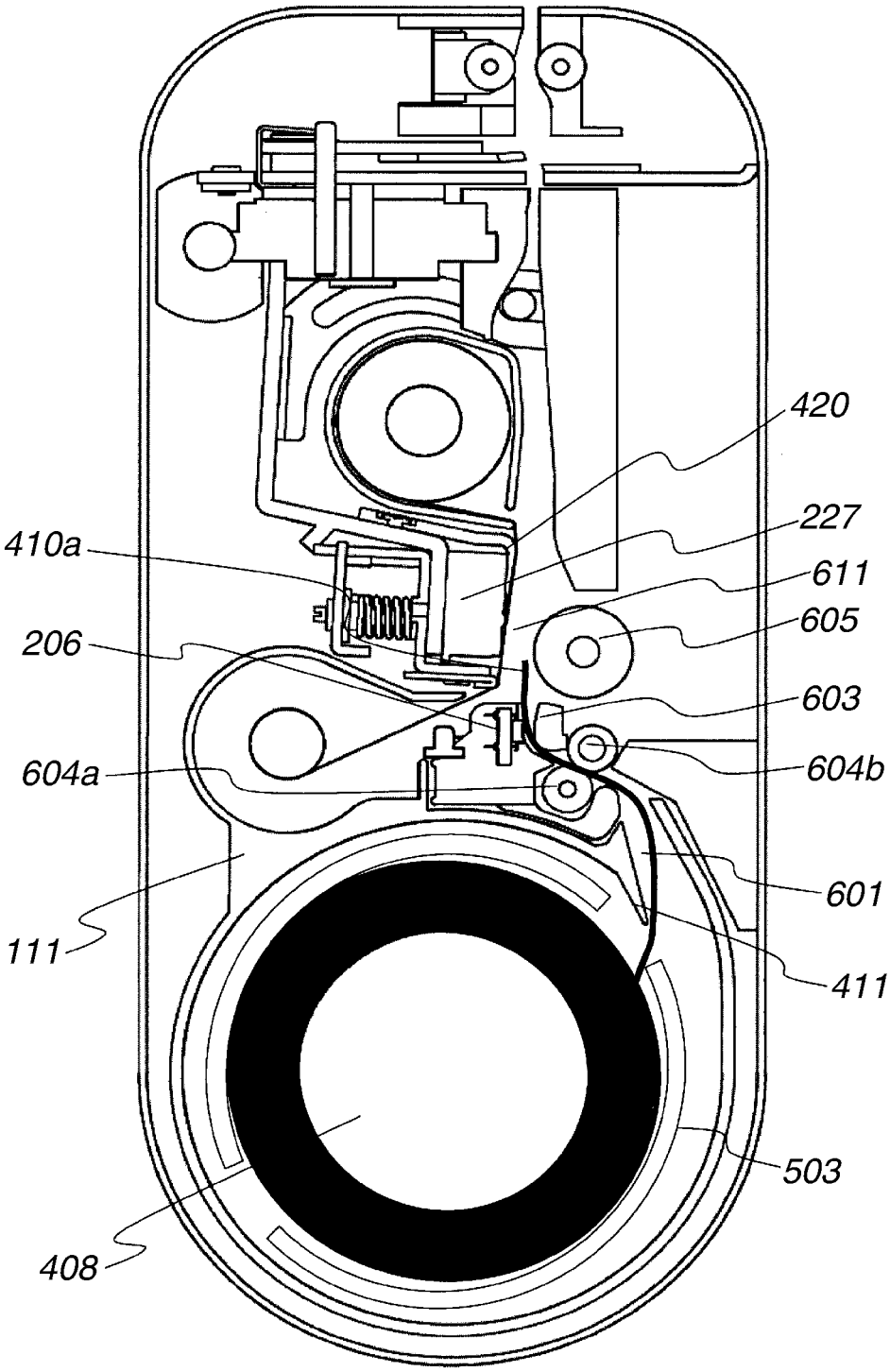
FIG. 11 illustrates another momentary position of the front end portion of the roll paper that is conveyed in the printing apparatus.

In a state where the roll paper 410 has reached the position illustrated in FIG. 11, the leading part of the roll paper 410 (including the front end portion 410*a*) is regulated by the guide member 603 so as to bend in a reversed direction with respect to the curvature of the roll paper 410 accommodated in the housing 111. Accordingly, the winding curl of the roll paper 410 can be corrected when the leading part of the roll paper 410 (including the front end portion 410*a*) passes through the curved portion 621 of the conveyance path 620.

Figure 12:
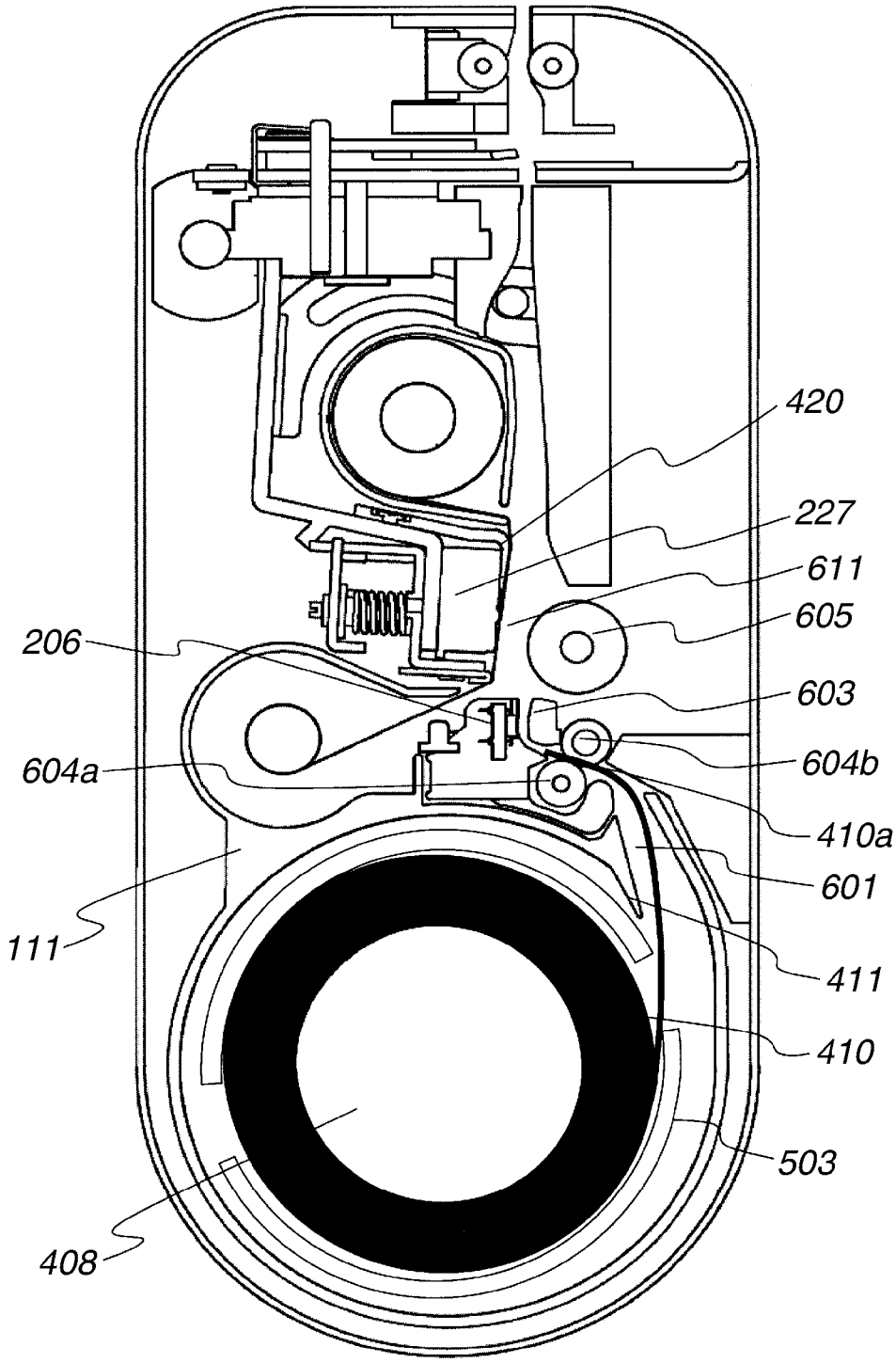
FIG. 12 illustrates another momentary position of the front end portion of the roll paper that is conveyed in the printing apparatus.

Next, the main controller 201 causes the conveyance motor driver 211 to control the conveyance motor 212 to move the roll paper 410 in the rearward direction (i.e., a roll paper take-up direction) so that the front end portion 410*a* of the roll paper 410 returns to a position where the front end portion 410*a* is positioned on the upstream side of the guide member 603 as illustrated in FIG. 12. Subsequently, the main controller 201 causes the conveyance motor driver 211 to control the conveyance motor 212 to convey the roll paper 410 forward again until the front end portion 410*a* of the roll paper 410 passes through the curved portion 621 of the conveyance path 620 as illustrated in FIG. 11. In this manner, reciprocating the roll paper 410 during its conveyance operation is effective to correct the winding curl that tends to remain at the front end portion of the roll paper 410.

Figure 13A:
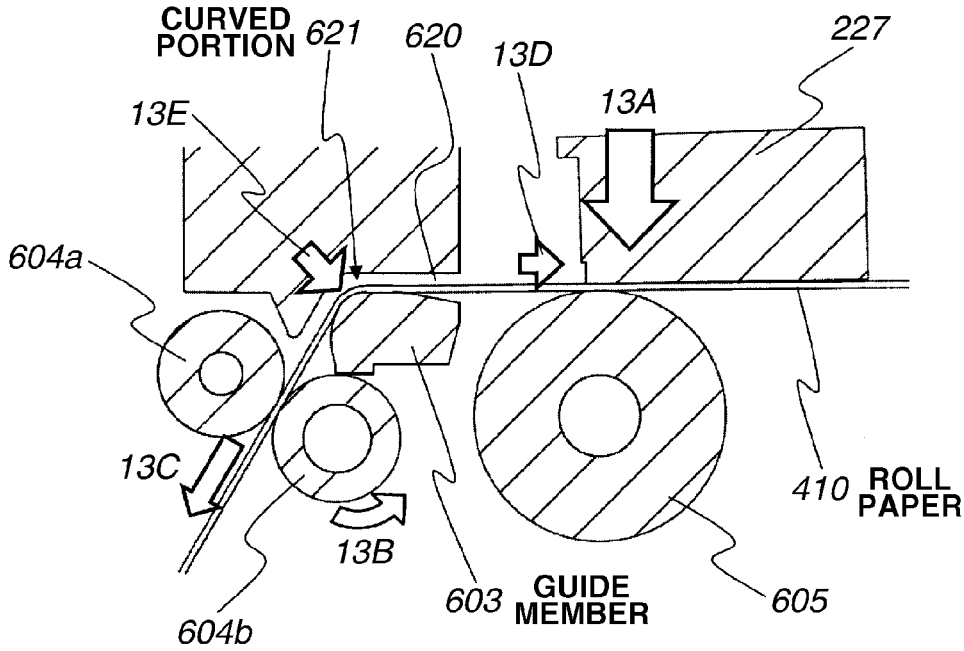
FIGS. 13A and 13B illustrate an example operation for correcting winding curl formed on a roll paper according to an exemplary embodiment of the present invention.
Figure 13B:
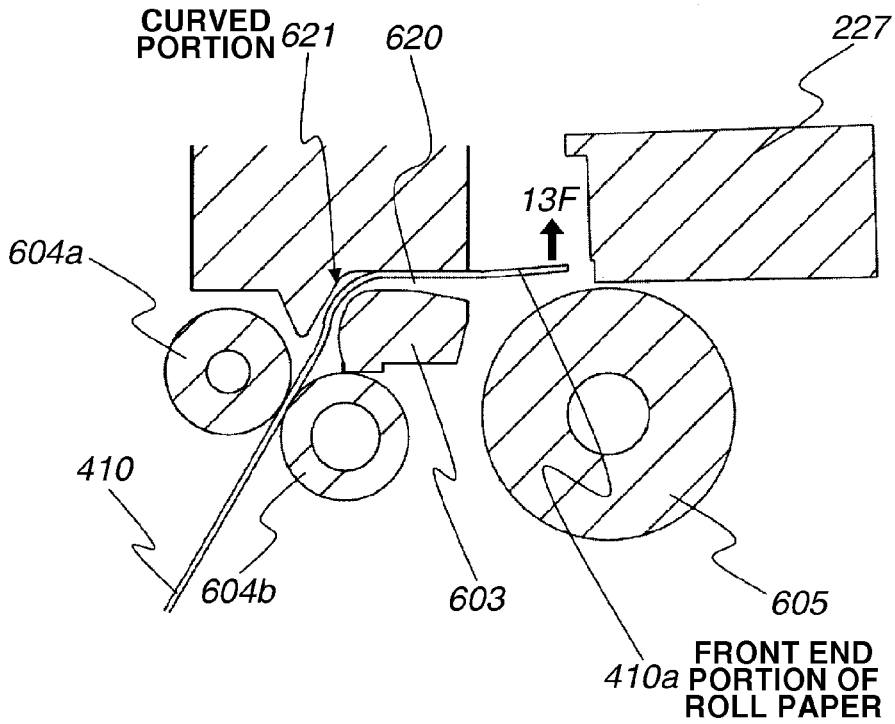

An example of the winding curl correction (decurling) operation is described below in more detail with reference to FIGS. 13A and 13B. FIGS. 13A and 13B are cross-sectional views schematically illustrating a positional relationship between the thermal head 227, the guide member 603, and the grip roller 604*b* that are located in the vicinity of the curved portion 621 of the conveyance path 620.

FIG. 13A illustrates a state where printing is performed on the roll paper 410, as an example state where the winding curl correction operation can be effectively performed. During the printing operation, the thermal head 227 is urged in a direction indicated by an arrow 13A and pressed against the platen roller 605 as illustrated in FIG. 13A. In this state, the roll paper 410 and the ink ribbon 420 are held between the thermal head 227 and the platen roller 605.

In FIGS. 13A and 13B, the ink ribbon 420 is not illustrated. In the printing operation, the grip roller 604*b* rotates in a direction indicated by an arrow 13B and conveys the roll paper 410 in a direction indicated by an arrow 13C. Thus, both a conveyance force for conveying the roll paper 410 generated by the grip roller 604*b* and a conveyance resistance (indicated by an arrow 13D) act on the roll paper 410 held between the thermal head 227 and the platen roller 605.

Therefore, a tensile force acts on the roll paper 410, and the roll paper 410 is pressed against an inner wall of the conveyance path 620 in the vicinity of the guide member 603 (as indicated by an arrow 13E). In this manner, in a state where the roll paper 410 is tightly brought into contact with the guide member 603, the roll paper 410 is bent along the outer shape of the guide member 603 and rubbed by the guide member 603. Thus, in the printing operation, the winding curl of the roll paper 410 can be effectively corrected.

FIG. 13B illustrates an example of the winding curl formed on the front end portion 410*a* of the roll paper 410. The roll paper 410 illustrated in FIG. 13B corresponds to a state immediately before the roll paper 410 is conveyed to the printing position 611 or immediately after the printing on the roll paper 410 is completed. In this case, the roll paper 410 is not held between the thermal head 227 and the platen roller 605. Therefore, no tensile force is applied to the roll paper 410.

Therefore, the front end portion 410*a* of the roll paper 410 rises upward as indicated by an arrow 13F and departs from the guide member 603. Accordingly, the effect of correcting the winding curl at the front end portion 410*a* of the roll paper 410 tends to become smaller compared to the central portion of the roll paper 410 (i.e., the central portion of a stretched part of the roll paper 410 having been pulled out of the wound part of the roll paper 410 in the longitudinal direction).

As described above, in the roll paper reciprocating conveyance processing (see step S102) according to the present exemplary embodiment, the front end portion 410*a* of the roll paper 410 is controlled to reciprocate at least one time beyond the curved portion 621 of the conveyance path 620. In this manner, the conveyance mechanism according to the present exemplary embodiment repetitively performs correction of the winding curl formed on the front end portion 410*a* of the roll paper 410. Therefore, the present exemplary embodiment can enhance the winding curl correction effect.

In this case, the winding curl correction is continuously performed until the front end portion 410*a* of the roll paper 410 is held between the thermal head 227 and the platen roller 605. The front end portion 410*a* of the roll paper 410 and its vicinity can be gradually decurled by repeating the above-described reciprocating conveyance operation for the roll paper 410.

To uniformalize the effect of decurling the entire roll paper 410, it is desired that the front end portion 410*a* of the roll paper 410 is set to be larger with respect to the number of times in passing through the curved portion 621 compared to the central portion of the stretched part of the roll paper 410 having been pulled out of the wound part of the roll paper 410 in the longitudinal direction. Further, reduction or elimination of the winding curl formed on the front end portion 410*a* of the roll paper 410 brings an effect that the roll paper 410 can be smoothly conveyed in the apparatus without being interfered with other components or parts provided in the apparatus.

In general, the state of the winding curl is different between an outer circumferential portion and an inner circumferential portion of the roll paper 410 wound in a roll shape. More specifically, the state of the winding curl formed at the front end portion 410*a* of the roll paper 410 is variable depending on the number of remaining printable sheets of the roll paper 410. Therefore, it is desired to take the state of the winding curl of the roll paper 410 into consideration in setting the number of times of the reciprocating conveyance operation to be performed for the roll paper 410.

To this end, it is desired that the conveyance mechanism for the printing apparatus 100 includes a remaining amount measuring unit configured to measure the remaining amount of the roll paper 410. For example, the remaining amount measuring unit detects a remaining amount of the ink ribbon 420 and calculates the number of printable sheets of the roll paper 410 based on the remaining amount of the ink ribbon 420. The main controller 201 can set the number of times of the reciprocating conveyance operation to be performed for the roll paper 410 according to the number of printable sheets calculated by the remaining amount measuring unit.

The remaining amount measuring unit is not limited to the above-described example and another comparable unit can be used. For example, the remaining amount measuring unit can be configured to measure a radial size of the roll paper 410 wound in a roll shape and identify the remaining amount of the roll paper 410 based on the measured radial size.

FIG. 14 illustrates an example setting with respect to the number of times of the reciprocating conveyance operation to be performed for the roll paper 410. According to the setting illustrated in FIG. 14, the number of times of the reciprocating conveyance operation is smaller when the remaining amount of the roll paper 410 wound in the cartridge is large. The setting illustrated in FIG. 14 is useful in uniformalizing the effect of correcting the winding curl of the roll paper 410 regardless of the remaining amount of the roll paper 410.

As described above, according to the present exemplary embodiment, the conveyance of the roll paper 410 is controlled in such a manner that the front end portion 410*a* of the roll paper 410 frequently passes through the curved portion compared to other portion of the roll paper 410 for the purpose of performing the correction of the winding curl using the curved portion before printing is performed on the roll paper 410. In other words, the number of times the front end portion 410*a* of the roll paper 410 passes through the curved portion is set to be larger.

The length of the front end portion 410*a* that frequently passes through the curved portion is set to be comparable to the length of the conveyance path extending from a position where the paper is held by the grip roller 604*b* to a position where the paper is held between the thermal head 227 and the platen roller 605, or comparable to the length from a position corresponding to the curved portion of the conveyance path to a position where the paper is held between the thermal head 227 and the platen roller 605. This setting is useful to obtain a sufficient amount of decurling effect, because a sufficient amount of tension acts on the roll paper 410 while the front end portion of the roll paper 410 having the above-described length is conveyed along the curved portion of the conveyance path.

If the roll paper reciprocating conveyance processing performed in step S102 is completed, then in step S103, the main controller 201 performs roll paper conveyance processing. More specifically, the main controller 201 causes the conveyance motor driver 211 to control the conveyance motor 212 to convey the roll paper 410 until a predetermined position of the roll paper 410 spaced from the front end portion 410*a* by an amount equivalent to the length of one sheet reaches the printing position 611. As described above, partly decurling the front end portion 410*a* of the roll paper 410 in advance is useful to uniformalize the winding curl of the roll paper 410 having been subjected to the print processing and to improve the quality of a printed product (i.e., the roll paper 410).

Next, an example of the printing operation is described below. The printing operation according to the present exemplary embodiment includes ink ribbon cuing processing to be performed in step S903 of the flowchart illustrated in FIG. 9, print processing to be performed in step S904, returning processing to be performed in step S905, and printing completion determination processing to be performed in step S906.

In the ink ribbon cuing processing performed in step S903, the main controller 201 causes the ink ribbon winding motor driver 216 to control the ink ribbon winding motor 217 to wind the ink ribbon 420 accommodated in the cartridge 110. More specifically, the ink ribbon winding motor 217 generates a winding force that is transmitted via a gear train to the ink ribbon 420.

Figure 15:
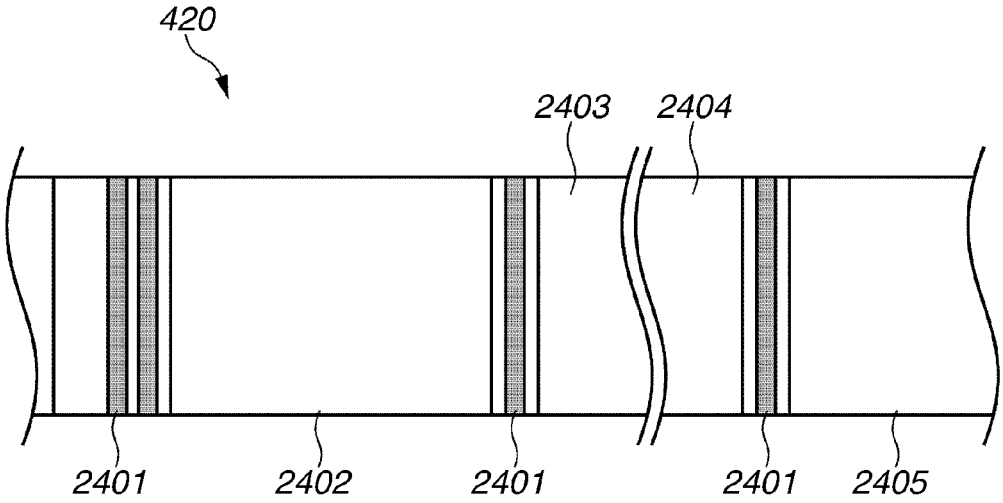
FIG. 15 illustrates a surface of an ink ribbon.

FIG. 15 illustrates example markers printed on the ink ribbon 420. In FIG. 15, a belt-like marker 2401 is printed at a position corresponding to each cue position of a yellow ink surface 2402, a magenta ink surface 2403, a cyan ink surface 2404, and an overcoat layer 2405 coated on the ink ribbon 420.

The marker 2401 is a black line, which can be detected by the ribbon cue sensor 207. The marker 2401 indicating a start position of the yellow ink surface 2402 includes two parallel black lines. On the other hand, the marker 2401 indicating a start position of other color surface includes only one black line.

The ribbon cue sensor 207 can discriminate the above-described two types of markers 2401 and transmit a signal indicating an identified result to the main controller 201. Therefore, the main controller 201 can recognize the cue position of the yellow ink surface 2402 to be first used in printing.

When the ribbon cue sensor 207 detects the marker 2401 indicating the start position of the yellow ink surface 2402, the main controller 201 causes the ink ribbon winding motor driver 216 to control the ink ribbon winding motor 217 to stop winding the ink ribbon 420. Meanwhile, the main controller 201 causes the head up/down motor driver 218 to control the head up/down motor 219 to move the thermal head 227 in the vertical direction until the thermal head 227 reaches the printing position 611.

The thermal head 227 is supported by a base frame of the printing apparatus 100 via a head lever 612 so as to be freely rotatable around a rotational shaft. The head up/down motor 219 can rotate the head lever 612 to move the thermal head 227 to the printing position 611. When the thermal head 227 has reached the printing position 611, the grip roller 604*b* conveys the roll paper 410 to successively transfer inks of the yellow, magenta, cyan, and overcoat layers in an overlapped state. During the above-described operation, the roll paper 410 is conveyed backward.

Figure 16A:
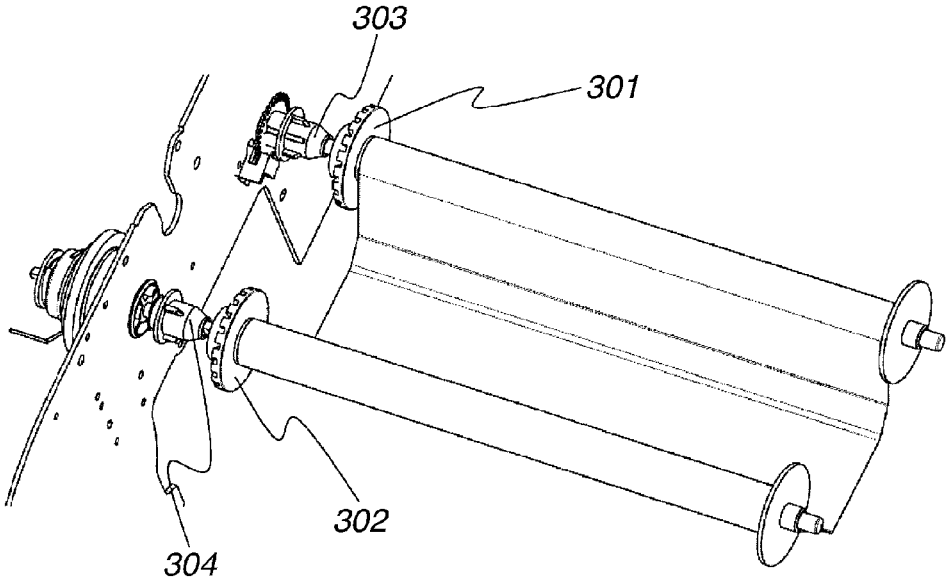
FIG. 16A is a perspective view illustrating an ink ribbon unit.

An example of a detecting operation to be performed during a printing operation is detection of the remaining amount of the ink ribbon 420. FIG. 16A illustrates the ink ribbon unit 402 that includes bobbins and associated driving joints. The ink ribbon unit 402 includes a supply side bobbin 301 around which an unused part of the ink ribbon 420 is wound and a take-up side bobbin 302 around which a used part of the ink ribbon is wound. Respective bobbins 301 and 302 are held in a rotatable state by joint portions 303 and 304, respectively.

Figure 16B:
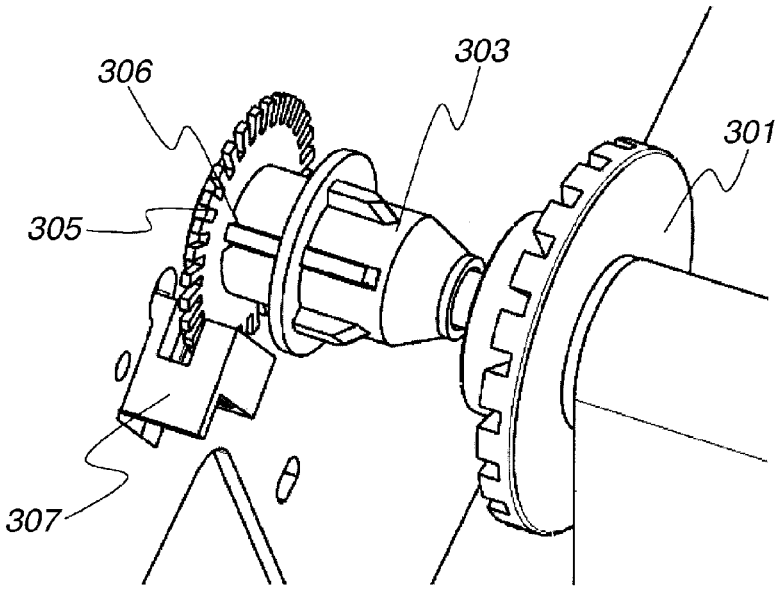
FIG. 16B is an enlarged perspective view illustrating a peripheral portion of a bobbin included in the ink ribbon unit.

FIG. 16B is a perspective view partly enlarging the supply side bobbin 301. An example detection of the remaining amount of the ink ribbon can be realized by measuring the number of rotations of the supply side bobbin 301. To measure the number of rotations, a disc 306 on which numerous slits 305 are provided is attached to the supply side joint portion 303. The disc 306 integrally rotates with the joint portion 303.

A transmission-type photo sensor 307 is disposed at a place where the slits 305 provided on the disc 306 are detectable. The photo sensor 307 is configured to detect light transmitted via the slits 305 provided on the disc 306. The photo sensor 307 can generate a signal representing a light transmission state and a signal representing a light shielded state. The rotational speed of the supply side joint portion 303 can be calculated by counting the number of pulses per unit time based on the signals generated by the photo sensor 307.

Figure 17A:
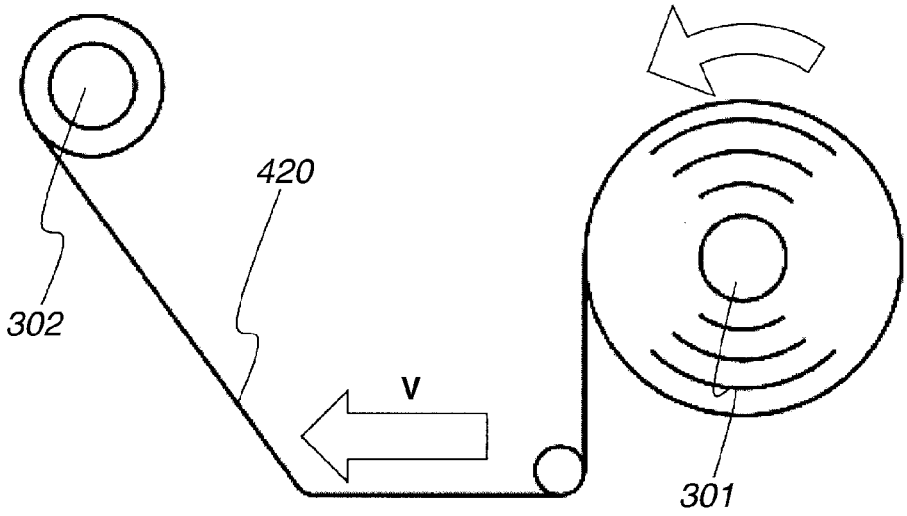
FIGS. 17A and 17B illustrate the speed of the ink ribbon in a take-up operation.

An example change in the rotational speed of the supply side joint portion 303 that is variable during a printing operation is described below with reference to FIGS. 17A and 17B.

A conveyance speed V of the ink ribbon 420 is constant during the printing operation. Therefore, the circumferential speed of the ink ribbon 420 is constant at the outermost layer of the ink ribbon 420 wound around the bobbins 301 and 302. Therefore, in a case where the radial size of the ink ribbon 420 wound around the supply side bobbin 301 is large as illustrated in FIG. 17A, the rotational speed of the supply side bobbin 301 is low.

Figure 17B:
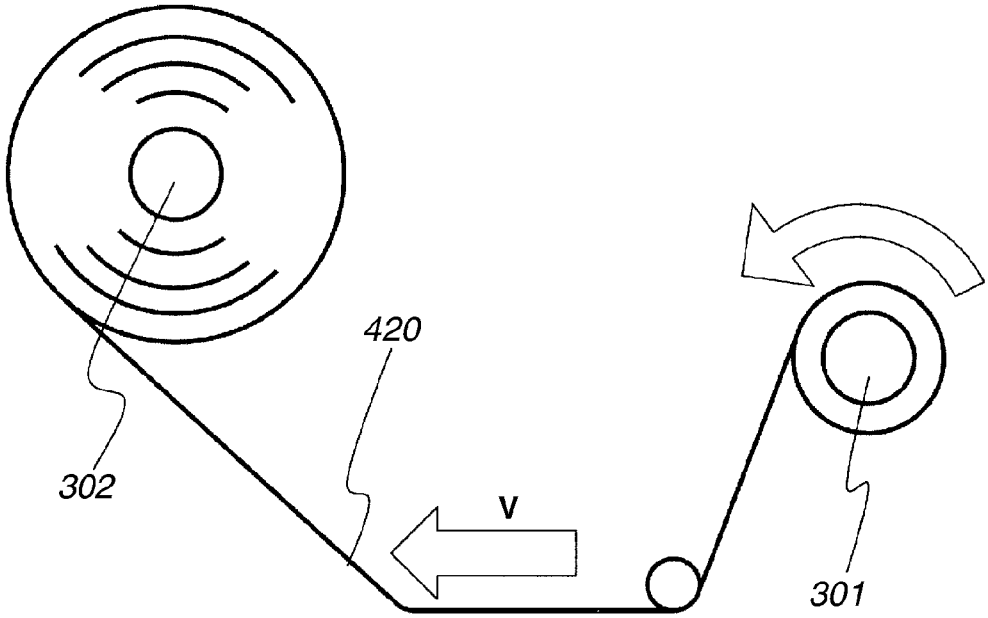

On the other hand, in a case where the radial size of the ink ribbon 420 wound around the supply side bobbin 301 is small as illustrated in FIG. 17B, the rotational speed of the supply side bobbin 301 is high. The above-described rotational speed difference can be used to detect the remaining amount of the ink ribbon 420.

Further, in a case where the cartridge is an integrated type as described in the above-described exemplary embodiment, the remaining amount of the ink ribbon 420 is equal to the remaining amount (the number of remaining printable sheets) of the roll paper 410 wound in a roll shape. Accordingly, the remaining amount of the roll paper 410 can be calculated based on the remaining amount of the ink ribbon 420.

Further, the remaining amount of the ink ribbon 420 can be similarly calculated by measuring the rotational speed of the take-up side joint portion 304. Further, various methods other than the above-described method can be used to calculate the remaining amount of the ink ribbon 420.

After completing the printing on the roll paper 410, the main controller 201 causes the head up/down motor driver 218 to control the head up/down motor 219 to rotate the head lever 612 to return the thermal head 227 to a predetermined retracted position. In this case, it is desired to further wind the ink ribbon 420 a little bit to tighten the ink ribbon 420.

Upon completing the printing, the main controller 201 performs sequential controls for conveying the roll paper 410 by a desired distance, cutting the roll paper 410, and discharging the cut roll paper 410. Namely, the main controller 201 performs pre-cutting conveyance processing in step S907, roll paper cutting processing in step S908, and roll paper discharge processing in step S909 of the flowchart illustrated in FIG. 9.

In the pre-cutting conveyance processing performed in step S907, the main controller 201 causes the conveyance motor driver 211 to control the conveyance motor 212 to convey the roll paper 410 in a paper discharge direction. In this case, the roll paper 410 is conveyed until a boundary between a printed area and an unprinted area on the roll paper 410 reaches a cutting position of the cutter unit 710. The main controller 201 performs the processing of step S907 in a state where the roll paper 410 is held between the grip roller 604*b* and the pinch roller 604*a*. Therefore, by rotating the grip roller 604*b* a predetermined amount, the roll paper 410 moves a corresponding amount in the paper discharge direction.

In the roll paper cutting processing performed in step S908, the main controller 201 causes the cutter motor driver 220 to control the cutter motor 221 (i.e., the cutter unit 710) to cut the roll paper 410. Further, in the roll paper discharge processing performed in step S909, the main controller 201 causes the conveyance motor driver 211 to control the conveyance motor 213 to rotate the discharge roller 606 to convey the cut roll paper 410 in the paper discharge direction. In this case, the front end portion of the roll paper 410 connected to the roll paper 410 accommodated in the cartridge 110 moves forward in the paper discharge direction. As a result, a print completed part of the roll paper 410 is pushed out by the front end portion of the unprinted roll paper 410 coming from the upstream side and is discharged to the outside of the apparatus.

Further, in a case where borderless printing is performed or in a case where the overcoat layer is transferred to a relatively larger area that is wider than a printed area, a printed portion may remain at the front end of the unprinted part of the roll paper 410 after the print completed part of the roll paper 410 is cut off. Therefore, it is desired to further convey the front end portion 410*a* of the roll paper 410 forward a little bit beyond the cutting position and cut the print remaining portion off the front end portion of the roll paper 410 by the cutter unit 710.

In this manner, the area wider than the printed area is cut in a printing operation. Therefore, even in a case where the area wider than the printed area passes through the curved portion in the printing operation, the portion having passed through the curved portion is completely cut off as a print product or a cut edge. Accordingly, at the moment when the printing operation is completed, the front end portion 410*a* of the roll paper 410 is a portion that is not yet subjected to the winding curl correction.

If the roll paper discharge processing performed in step S909 is completed, then in step S910, the main controller 201 performs roll paper storing processing to take up the unprinted part of the roll paper 410. Thus, the roll paper 410 is entirely stored into the cartridge 110 and the cartridge 110 can be detached from the printing apparatus 100.

In the roll paper storing processing performed in step S910, the main controller 201 causes the conveyance motor driver 211 to control the conveyance motor 212 to rotate the grip roller 604*b* in the opposite direction to take up the roll paper 410. At the same time, the main controller 201 causes the feeding motor driver 214 to control the feeding motor 215 to rotate the roller 408 in the opposite direction to take up the roll paper 410. The main controller 201 once stops the above-described roll paper storing processing if it is determined, based on a detection signal of the roll paper detection sensor 206, that the roll paper 410 has been taken up beyond the setup position of the roll paper detection sensor 206. Subsequently, the main controller 201 causes both the grip roller 604*b* and the roller 408 to further make a rotation of a predetermined amount to surely store the roll paper 410 in the cartridge 110.

As described above, the first exemplary embodiment enhances the decurling effect at the front end portion 410*a* of the roll paper 410. To this end, the number of times of the reciprocating conveyance operation (i.e., the operation for enforcing the roll paper 410 to pass through a curved portion in a reciprocating fashion) is set to be a larger value for the front end portion 410*a* of the roll paper 410 compared to a value set for other portion of the roll paper 410. Thus, the first exemplary embodiment can uniformalize the winding curl of the entire roll paper 410.

Figure 18:
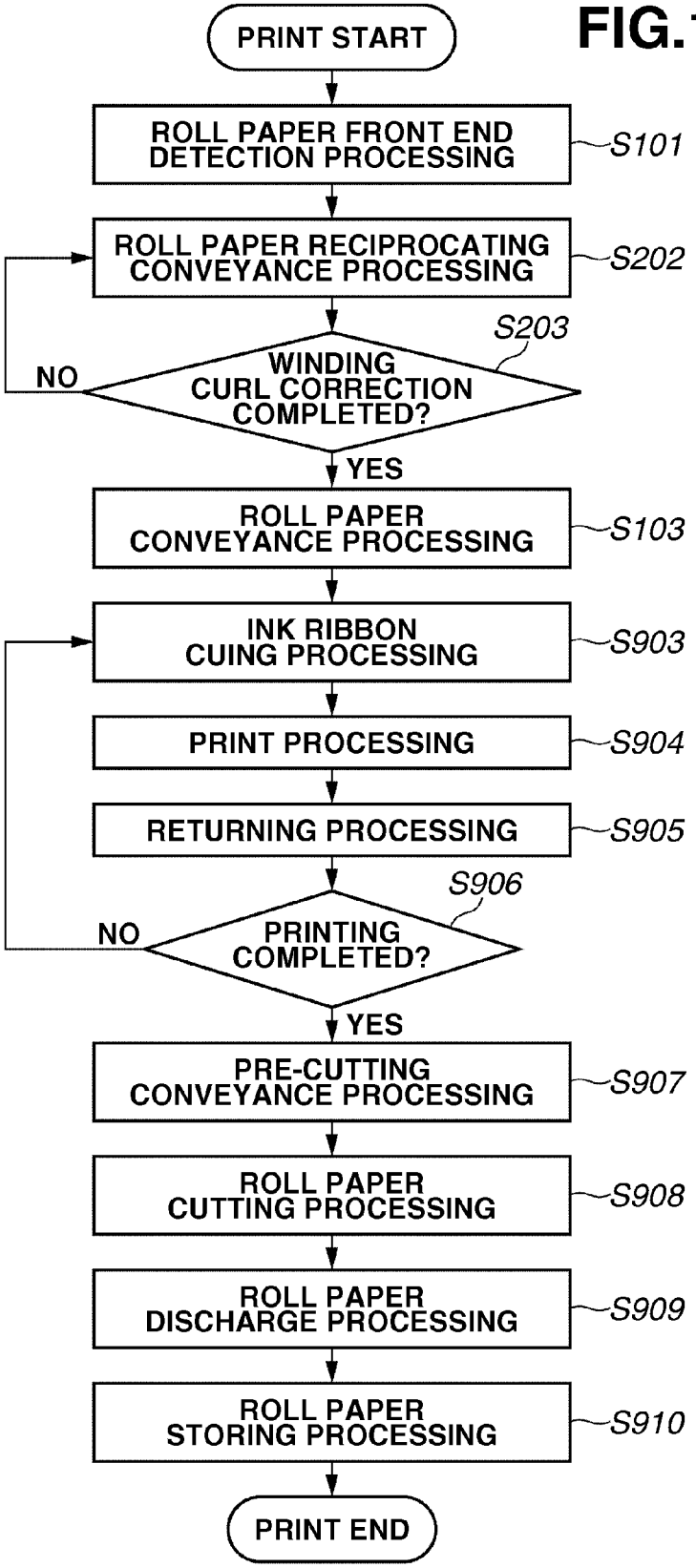
FIG. 18 is a flowchart illustrating an example procedure of print processing that can be performed by the printing apparatus according to a second exemplary embodiment of the present invention.

Next, a second exemplary embodiment of the present invention is described below. The printing apparatus 100 according to the second exemplary embodiment has a configuration similar to that described in the first exemplary embodiment. FIG. 18 is a flowchart illustrating sequential operations (from print start to print end) to be performed in the print processing according to the second present exemplary embodiment.

At the print start timing, the front end portion 410*a* of the roll paper 410 is accommodated in the cartridge 110. In step S101, the main controller 201 performs roll paper front end detection processing similar to the processing described in the first exemplary embodiment although its description is not repeated.

If the roll paper front end detection processing performed in step S101 is completed, then in step S202, the main controller 201 performs roll paper reciprocating conveyance processing. The processing for conveying the roll paper 410 in this step is similar to the processing described in the first exemplary embodiment. However, in the present exemplary embodiment, the main controller 201 detects the presence of the roll paper 410 at the curved portion 621 of the conveyance path 620 based on a detection signal of the roll paper detection sensor 206, while the main controller 201 controls the reciprocating conveyance operation to be performed for the roll paper 410. The roll paper detection sensor 206 detects the roll paper 410 repetitively during the reciprocating conveyance processing performed for the roll paper 410. In step S203, the main controller 201 determines whether the processing for correcting the winding curl of the front end portion 410*a* of the roll paper 410 has been completed referring to a change in the time interval between two detections of the roll paper 410.

Figure 19:
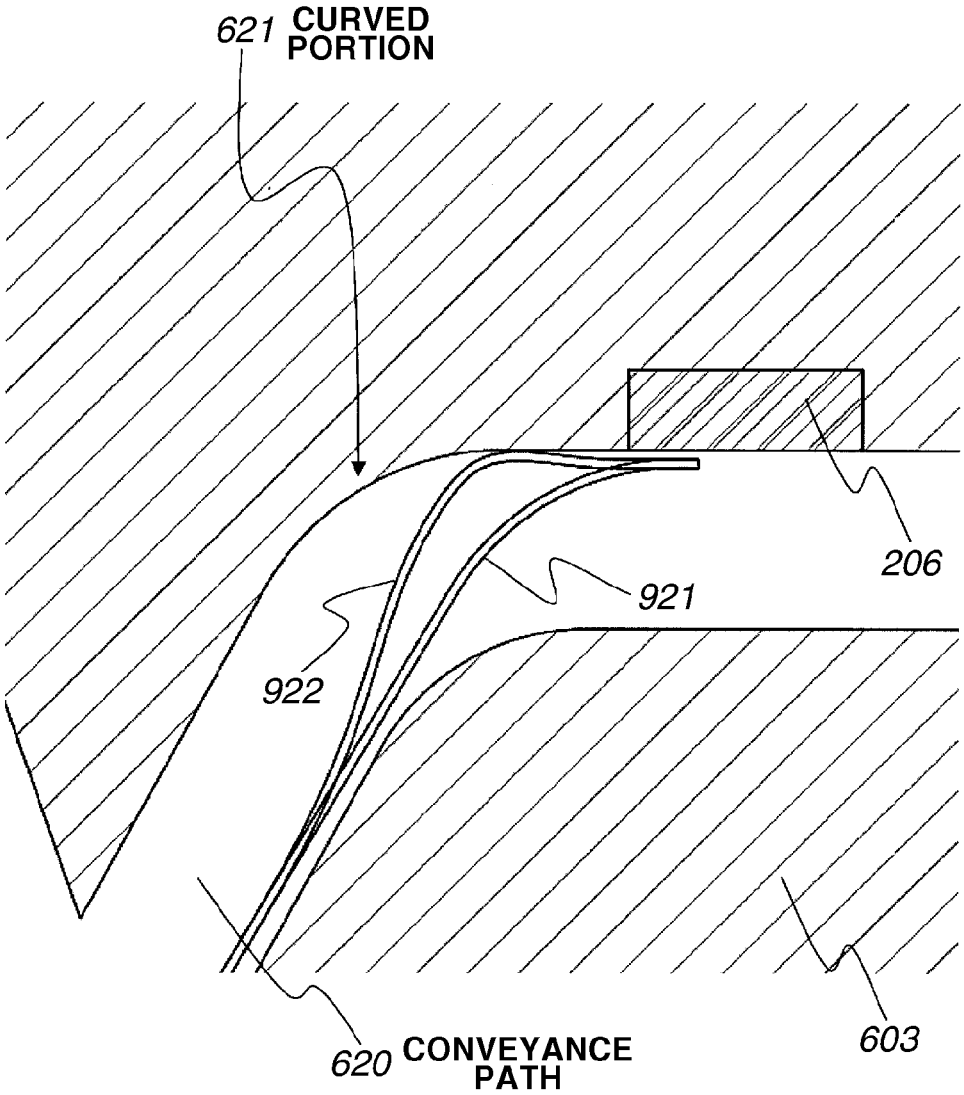
FIG. 19 illustrates example states of the roll paper positioned in the vicinity of a curved portion in a conveyance path.

Hereinafter, an example relationship between a state of the winding curl of the roll paper 410 and a change amount of the time interval in the roll paper detection during the reciprocating conveyance operation is described below. FIG. 19 is a cross-sectional view illustrating example states of the roll paper positioned in the vicinity of the curved portion 621 in the conveyance path 620. The winding curl of a roll paper 922 is larger than that of another roll paper 921. A front end portion of the roll paper 922 greatly deforms on the side of the roll paper detection sensor 206, compared to a front end portion of the roll paper 921. Therefore, a conveyance distance required for the roll paper 922 to reach the roll paper detection sensor 206 is longer compared to a conveyance distance required for the roll paper 921.

Figure 20A:
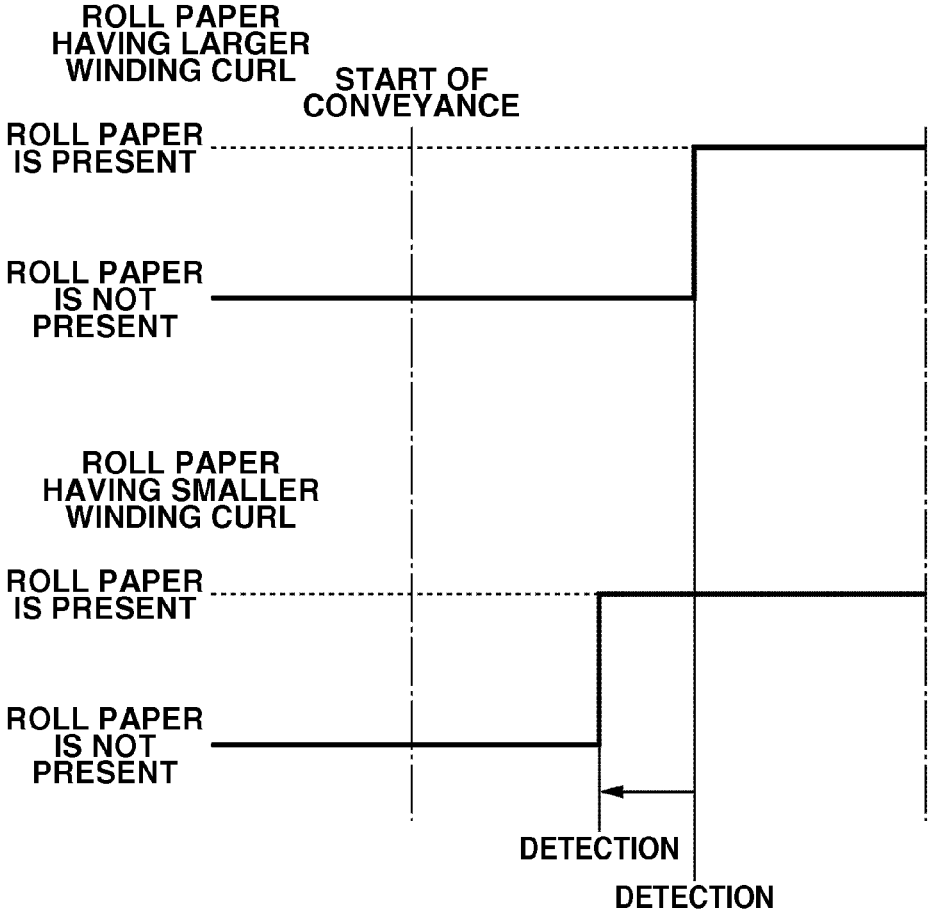
FIG. 20A is a timing diagram illustrating example roll paper detection in the reciprocating conveyance operation.

Next, a time difference in the process of conveying the roll paper in the forward direction (i.e., the paper discharge direction) after the roll paper is once taken up until the roll paper detection sensor 206 detects the roll paper, in the roll paper reciprocating conveyance processing in step S202, is described below with reference to FIG. 20A. FIG. 20A illustrates a comparison in detection of the roll paper 922 having a larger winding curl and the roll paper 921 having a smaller winding curl.

As described above, the greatly curled roll paper 922 travels a relatively longer conveyance distance until it reaches the detection position (i.e., the roll paper detection sensor 206). Therefore, the roll paper detection sensor 206 requires a relatively long time to detect the front end portion of the roll paper 922. On the other hand, the roll paper 921 having a smaller winding curl travels a relatively shorter conveyance distance until it reaches the detection position. Therefore, the roll paper detection sensor 206 requires a relatively short time to detect the front end portion of the roll paper 921. In this manner, repetitively performing the reciprocating conveyance operation is useful to reduce the winding curl of the roll paper and reduce the time required for the roll paper detection.

Figure 20B:
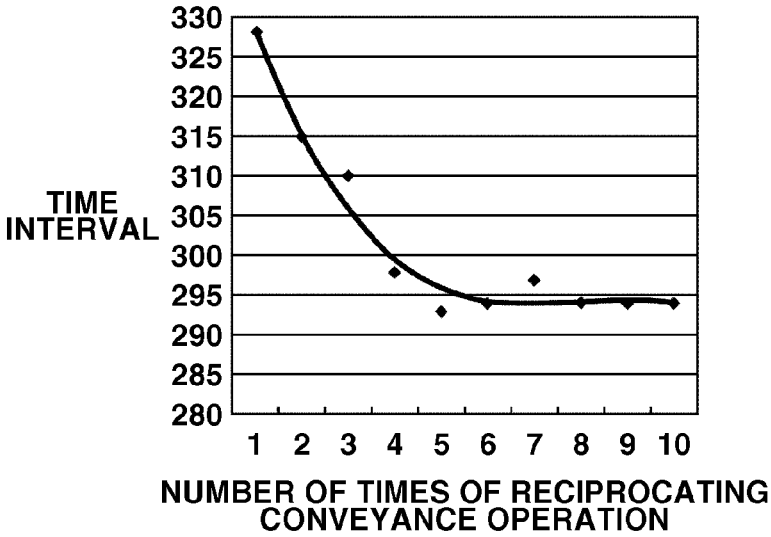
FIG. 20B is a graph illustrating a relationship between time interval of the roll paper detection and the number of times of the reciprocating conveyance operation.

Further, as illustrated in FIG. 20B, the effect of correcting the winding curl of a roll paper increases in accordance with the number of times of the reciprocating conveyance operation. However, the winding curl correction substantially stops if the number of times of the reciprocating conveyance operation increases sufficiently. Therefore, in step S203, the main controller 201 determines that the winding curl correction processing has been completed at the time when the time interval in the roll paper detection becomes constant.

As described above, the main controller 201 stores a first time indicating the timing when the front end portion of the roll paper has passed through the curved portion 621. After the detection and storage of the first time, the roll paper is once taken up backward and again conveyed forward. Subsequently, the main controller 201 stores a second time indicating the timing when the front end portion of the roll paper has passed through the curved portion 621. The main controller 201 compares the first time and the second time, and determines whether the winding curl correction for the front end portion of the roll paper has completed. The first and second times are stored in the storage unit 230.

If it is determined that the winding curl correction processing has been completed (YES in step S203), then in step S103, the main controller 201 performs roll paper conveyance processing. Further, the main controller 201 performs processing similar to steps S903 to S910 described in the first exemplary embodiment.

Figure 21:
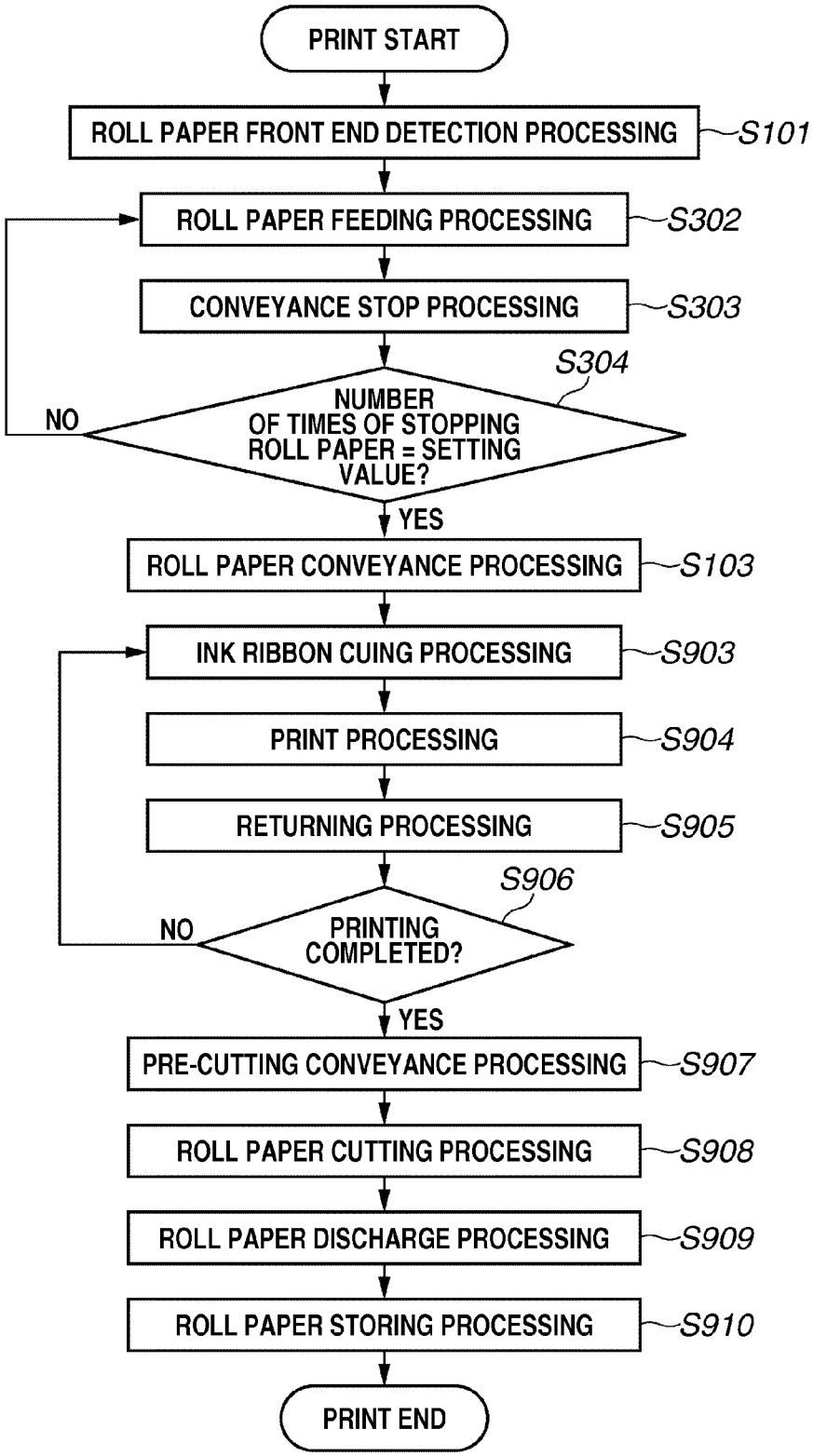
FIG. 21 is a flowchart illustrating an example procedure of print processing that can be performed by the printing apparatus according to a third exemplary embodiment of the present invention.

Next, a third exemplary embodiment is described below. The printing apparatus 100 according to the third exemplary embodiment has a configuration similar to that described in the first exemplary embodiment. FIG. 21 is a flowchart illustrating sequential operations (from print start to print end) to be performed in the print processing according to the third present exemplary embodiment.

At the print start timing illustrated in FIG. 21, the front end portion 410*a* of the roll paper is accommodated in the housing 111. In step S101, the main controller 201 performs roll paper front end detection processing similar to the processing described in the first exemplary embodiment although its description is not repeated.

If the roll paper front end detection processing performed in step S101 is completed, then in step S302, the main controller 201 performs roll paper feeding processing for feeding the roll paper by a predetermined amount to correct the winding curl. In this case, the main controller 201 causes the conveyance motor driver 211 to control the conveyance motor 212 to rotate the grip roller 604*b* to convey the roll paper 410 forward until the front end portion 410*a* of the roll paper 410 passes through the curved portion 621 of the conveyance path 620 and the roll paper 410 is held in a bent state in the vicinity of the front end portion 410*a* (see FIG. 10). Then in step S303, the main controller 201 performs conveyance stop processing, according to which the roll paper conveyance operation is stopped for a predetermined time.

Temporarily stopping the roll paper conveyance operation in this manner is effective to improve the effect of correcting the winding curl of a roll paper because the bent state of the roll paper can be maintained for a while. Then, the main controller 201 repeats the roll paper feeding processing performed in step S302 and the conveyance stop processing performed in step S303 until a predetermined area in the vicinity of the front end portion 410*a* of the roll paper 410 passes through the curved portion 621 of the conveyance path 620.

In this manner, the main controller 201 performs the control for intermittently stopping the roll paper 410 by predetermined times, to enhance the effect of correcting the winding curl in the vicinity of the front end portion 410*a* of the roll paper 410. In this case, it is desired to perform the above-described operation for intermittently stopping the roll paper 410 while conveying the same until the front end portion 410*a* of the roll paper 410 reaches the printing position 611 where the roll paper 410 is held between the platen roller 605 and the thermal head 227 on the downstream side of the conveyance path in the conveyance direction. In this manner, the third exemplary embodiment can uniformalize the winding curl of the entire roll paper 410 by correcting the winding curl formed on the front end portion 410*a* of the roll paper 410 beforehand.

Figure 22:
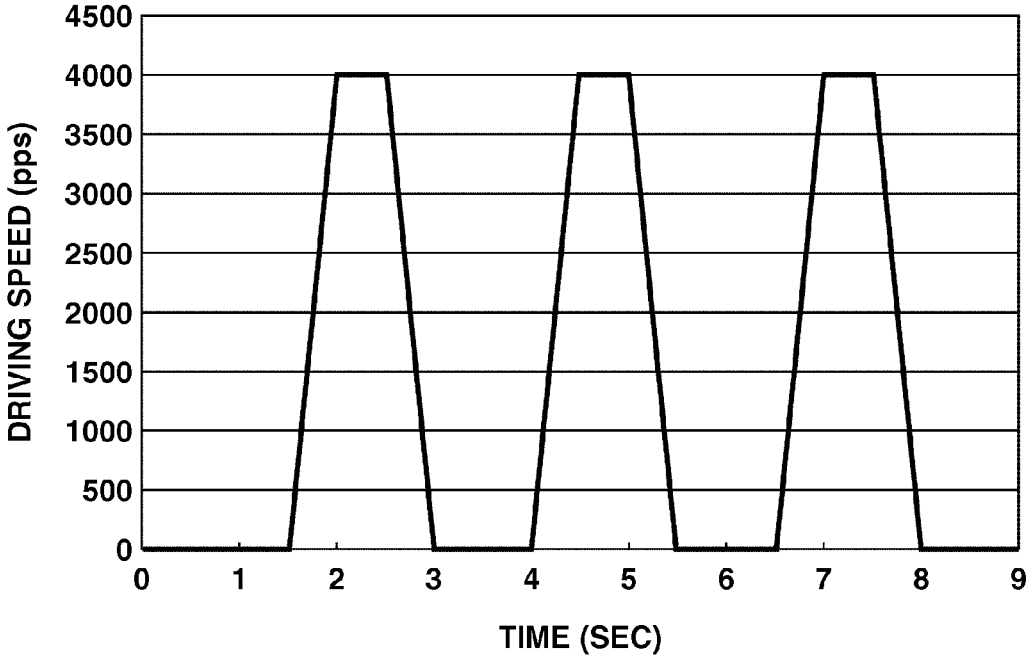
FIG. 22 is a graph illustrating a temporal change in the driving speed of a roll paper conveyance motor.

FIG. 22 illustrates an example relationship between conveyance speed and elapsed time. A motor driving speed illustrated in FIG. 22 indirectly indicates the conveyance speed. Intermittently conveying the roll paper 410 as illustrated in FIG. 22 is effective to forcibly correcting the winding curl in the vicinity of the front end portion 410*a* of the roll paper 410. Therefore, the printing apparatus 100 according to the third exemplary embodiment can surely convey the roll paper 410 without causing any interference with other components or parts provided in the apparatus.

Further, similar to the first exemplary embodiment, it is desired to control the conveyance of the roll paper 410 according to the remaining amount of the roll paper 410 (i.e., the number of remaining printable sheets). FIG. 23A illustrates an example of the number of times with respect to stoppage of the roll paper, which is variable depending on the number of remaining printable sheets. FIG. 23B illustrates an example of the time interval during which the roll paper is stopped, which is variable depending on the number of remaining printable sheets.

In this manner, in the present exemplary embodiment, the roll paper stop time or the number of times of the stoppage is set to be larger when the remaining amount of the roll paper is small. In other words, the present exemplary embodiment can uniformalize the winding curl correction effect in the entire area of the roll paper wound in the housing 111 regardless of the radial size of the roll paper.

In step S304, the main controller 201 determines whether the number of times the roll paper has been stopped is equal to a setting value. If it is determined that the number of times the roll paper has been stopped is equal to the setting value, then in step S103, the main controller 201 performs the roll paper conveyance processing. Further, the main controller 201 performs processing similar to the processing of steps S903 to S910 described in the first exemplary embodiment.

In the above-described third exemplary embodiment, the main controller 201 causes the front end portion 410*a* of the roll paper 410 to stop at the curved portion 621 of the conveyance path 620. However, the roll paper 410 does not need to be completely stopped. For example, it is useful to slowly convey the roll paper 410 when the front end portion 410*a* of the roll paper 410 passes through the curved portion 621 of the conveyance path 620. It is desired to set a total period of time the front end portion 410*a* of the roll paper 410 passes through the curved portion 621 to be greater than a total period of time the central portion of the stretched part of the roll paper 410 having been pulled out of the wound part of the roll paper 410 in the longitudinal direction passes through the curved portion 621. Further, instead of controlling the stop duration or the number of times of the stoppage, it is useful to change the conveyance speed of the roll paper 410 to decrease the conveyance speed of the front end portion 410*a* of the roll paper 410, so as to enhance the effect of decurling the front end portion 410*a*.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-165680 filed Jul. 14, 2009, which is hereby incorporated by reference herein in its entirety.

What is claimed is:

1. A conveyance mechanism comprising:

a conveyance path via which a leading part of a roll paper is conveyed, and including a curved portion bent toward a direction opposite to a wounding direction of the roll paper; and a control unit configured to control conveyance of the roll paper in such a manner that a front end portion of the roll paper becomes greater with respect to number of times or total time in passing through the curved portion compared to a central portion of the leading part of the roll paper.

2. The conveyance mechanism according to claim 1, wherein the control unit is configured to control the conveyance of the roll paper in such a manner that the front end portion of the roll paper stops at or in the vicinity of the curved portion for a predetermined time.

3. The conveyance mechanism according to claim 1, wherein the control unit is configured to control the conveyance of the roll paper in such a manner that the front end portion of the roll paper stops at or in the vicinity of the curved portion a predetermined number of times.

4. The conveyance mechanism according to claim 1, wherein the control unit is configured to control the conveyance of the roll paper in such a manner that the front end portion of the roll paper passes through the curved portion at least one time in a reciprocating fashion.

5. The conveyance mechanism according to claim 4, further comprising:

a roll paper detection sensor configured to detect the front end portion of the roll paper when the front end portion of the roll paper passes through the curved portion of the conveyance path; and a storage unit configured to store time information obtained when the front end portion of the roll paper is detected by the roll paper detection sensor, wherein the control unit is configured to determine whether winding curl correction processing for the front end portion of the roll paper is completed based on a comparison between a first time and a second time, wherein the first time is time information indicating a first detection of the front end portion of the roll paper passing through the curved portion, and the second time is time information indicating a second detection of the front end portion of the roll paper passing through the curved portion after the roll paper is once taken up backward and again conveyed forward.

6. The conveyance mechanism according to claim 1, further comprising:

a remaining amount measuring unit configured to measure a remaining amount of the roll paper, wherein, in a case where the remaining amount of the roll paper is smaller, the control unit sets a larger value for the front end portion of the roll paper with respect to the number of times or the total time in passing through the curved portion.

7. The conveyance mechanism according to claim 6, wherein the remaining amount measuring unit measures a radial size of the roll paper wound in a roll shape and calculate the remaining amount of the roll paper based on the measured radial size.

8. A recording apparatus that performs recording on a roll paper conveyed by a conveyance mechanism, wherein the conveyance mechanism comprises:

a conveyance path via which a leading part of a roll paper pulled out of a wound part of the roll paper is conveyed, and including a curved portion bent toward a direction opposed to a wounding direction of the roll paper; and a control unit configured to control a front end portion of the roll paper to be greater with respect to number of times or total time in passing through the curved portion compared to a central portion of the leading part of the roll paper pulled out of the roll paper wound.

9. The recording apparatus according to claim 8, further comprising:

an ink ribbon to be used to record an ink image on the roll paper;

a pair of rollers disposed on an upstream side of the curved portion in a conveyance direction and configured to hold the roll paper; and a thermal head and a platen roller disposed on a downstream side of the curved portion in the conveyance direction and configured to perform recording while holding the ink ribbon and the roll paper.

10. The recording apparatus according to claim 8, further comprising:

an ink ribbon to be used to record an ink image on the roll paper;

a cartridge configured to accommodate the ink ribbon and the roll paper wound in a roll shape; and a remaining amount measuring unit configured to measure a remaining amount of the roll paper based on a remaining amount of the ink ribbon.

11. A conveyance method for a conveyance mechanism configured to convey a leading part of a roll paper pulled out of a wound part of the roll paper via a conveyance path including a curved portion bent toward a direction opposite to a winding direction of the roll paper wound, the conveyance method comprising:

controlling conveyance of the roll paper in such a manner that a front end portion of the roll paper becomes greater with respect to number of times or total time in passing through the curved portion compared to a central portion of the leading part of the roll paper pulled out of the roll paper wound.

12. The conveyance method according to claim 11, further comprising:

controlling the conveyance of the roll paper in such a manner that the front end portion of the roll paper stops at or in the vicinity of the curved portion for a predetermined time.

13. The conveyance method according to claim 11, further comprising:

controlling the conveyance of the roll paper in such a manner that the front end portion of the roll paper stops at or in the vicinity of the curved portion a predetermined number of times.

14. The conveyance method according to claim 11, further comprising:

controlling the conveyance of the roll paper in such a manner that the front end portion of the roll paper passes through the curved portion at least one time in a reciprocating fashion.

15. The conveyance method according to claim 14, further comprising:

detecting the front end portion of the roll paper when the front end portion of the roll paper passes through the curved portion of the conveyance path;

storing a first time indicating a first detection of the front end portion of the roll paper passing through the curved portion;

detecting the front end portion of the roll paper after the roll paper is once taken up backward and again conveyed forward;

storing a second time indicating a second detection of the front end portion of the roll paper passing through the curved portion; and determining whether winding curl correction processing for the front end portion of the roll paper is completed based on a comparison between the first time and the second time.

16. The conveyance method according to claim 11, further comprising:

measuring a remaining amount of the roll paper; and setting, as the remaining amount of the roll paper is smaller, a larger value for the front end portion of the roll paper with respect to the number of times or the total time in passing through the curved portion.

17. A conveyance mechanism comprising:

a conveyance path via which a leading part of a roll paper is conveyed, and including a curved portion bent toward a direction opposite to a wounding direction of the roll paper; and a control unit configured to control conveyance of the roll paper in such a manner that a front end portion of the roll paper becomes greater with respect to conveyance speed in passing through the curved portion compared to a central portion of the leading part of the roll paper.

18. A conveyance method for a conveyance mechanism configured to convey a leading part of a roll paper pulled out of a wound part of the roll paper via a conveyance path including a curved portion bent toward a direction opposite to a winding direction of the roll paper wound, the conveyance method comprising:

controlling conveyance of the roll paper in such a manner that a front end portion of the roll paper becomes greater with respect to conveyance speed in passing through the curved portion compared to a central portion of the leading part of the roll paper pulled out of the roll paper wound.

* * * * *